US006283720B1

(12) United States Patent
Kottke

(10) Patent No.: US 6,283,720 B1
(45) Date of Patent: Sep. 4, 2001

(54) RECIPROCATING PUMPS WITH LINEAR MOTOR DRIVER

(75) Inventor: William Curtis Kottke, Fogelsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/669,366

(22) Filed: Sep. 26, 2000

Related U.S. Application Data

(62) Division of application No. 09/225,804, filed on Jan. 5, 1999, now Pat. No. 6,203,288.

(51) Int. Cl.[7] ..... F04B 17/00; F04B 17/04

(52) U.S. Cl. ..... 417/53; 417/410.1; 417/416

(58) Field of Search ..... 417/53, 321, 328, 417/410.1, 412, 415–417, 443–444, 510, 545

(56) References Cited

U.S. PATENT DOCUMENTS

| | | | |
|---|---|---|---|
| 2,003,647 | 4/1935 | Dillstrom . | |
| 4,239,460 | 12/1980 | Golz | 417/251 |
| 4,334,180 | 6/1982 | Bramm et al. | 318/687 |
| 4,350,478 | 9/1982 | Oldershaw et al. | 417/417 |
| 4,365,942 | 12/1982 | Schmidt | 417/412 |
| 4,396,354 | 8/1983 | Thompson et al. | 417/53 |

(List continued on next page.)

FOREIGN PATENT DOCUMENTS 2903817 8/1990 (DE) .

*Primary Examiner*—Teresa Walberg
*Assistant Examiner*—Thor Campbell
(74) *Attorney, Agent, or Firm*—Willard Jones, II

(57) ABSTRACT

A reciprocating pump includes a cylinder with a closed interior compartment. A piston assembly has a dispensing end and an opposed end and is moveably mounted within the compartment for reciprocating movement in opposed linear directions between opposed ends of the closed interior compartment. A linear magnetic drive generates a linearly moving magnetic field for moving the piston assembly in opposed linear directions through a swept volume in each of said opposed linear directions, one of said linear directions being a dispensing stroke and the other of said linear directions being a suction stroke. A sealing member is provided between the cylinder and the piston assembly to divide the interior compartment of the cylinder into a dispensing chamber and a reservoir chamber. A valve-controlled inlet conduit communicates with the dispensing chamber from which liquid is dispensed and a valve-controlled outlet conduit communicates with the dispensing chamber for directing pumped liquid out of the interior compartment as the piston assembly is moved through the swept volume in a dispensing stroke. An energy storage and release media communicates with the reservoir chamber for storing energy as a result of movement of the piston assembly in a direction away from the dispensing end of the interior compartment and for releasing the stored energy as the piston assembly is moved in a direction toward the dispensing end of the interior compartment. In certain preferred embodiments, the pumps are hermetic and the energy storage and release media includes a gaseous substance in the reservoir chamber. Methods of pumping liquids with the pumps of this invention also constitute a part of the present invention.

63 Claims, 7 Drawing Sheets

U.S. PATENT DOCUMENTS

| | | | |
|---|---|---|---|
| 4,396,362 | 8/1983 | Thompson et al. | 417/439 |
| 4,518,317 | 5/1985 | Inoue | 417/45 |
| 4,687,054 | 8/1987 | Russell et al. | 166/66.4 |
| 4,692,673 | 9/1987 | DeLong | 318/132 |
| 4,792,289 | 12/1988 | Nieratschker | 417/259 |
| 4,965,864 | 10/1990 | Roth . | |
| 5,083,905 | 1/1992 | Mohn | 417/45 |
| 5,085,563 | 2/1992 | Collins et al. | 417/417 |
| 5,179,306 | 1/1993 | Nasar | 310/14 |
| 5,252,043 | 10/1993 | Bolding et al. | 417/417 |
| 5,409,356 | 4/1995 | Massie | 417/416 |
| 5,511,955 | 4/1996 | Brown et al. | 417/259 |
| 5,575,626 | 11/1996 | Brown et al. | 417/251 |
| 5,734,209 | 3/1998 | Hallidy | 310/12 |
| 5,831,353 | 11/1998 | Bolding et al. | 310/12 |
| 6,015,270 | 1/2000 | Roth | 417/259 |

RECIPROCATING PUMPS WITH LINEAR MOTOR DRIVER

CROSS REFERENCE TO RELATED APPLICATIONS

This application is a divisional of application Ser. No. 09/225,804, filed Jan. 5, 1999, now U.S. Pat. No. 6,203,288.

STATEMENT REGARDING FEDERALLY SPONSORED RESEARCH OR DEVELOPMENT

Not Applicable

BACKGROUND OF THE INVENTION

The present invention relates to reciprocating pumps, and in particular to various types of reciprocating pumps with a linear motor driver and to methods of pumping liquids with such reciprocating pump. Most preferably the pumps of this invention are hermetic reciprocating pumps and the methods of this invention are methods of pumping liquids with such hermetic pumps.

Reciprocating pumps are highly desirable for use in numerous applications, particularly in environments where liquid flow rate is low (e.g., less than 15 gpm) and the required liquid pressure rise is high (e.g., greater than 500 psi). For applications requiring less pressure rise and greater flow rate, single stage centrifugal pumps are favored because of their simplicity, low cost and low maintenance requirements. However, reciprocating pumps have a higher thermodynamic efficiency than centrifugal pumps by as much as 10% to 30%. Although reciprocating pumps are preferred for many applications, they are subject to certain drawbacks and limitations.

For example, traditional reciprocating pumps are commonly driven in a linear direction by a rotating drive mechanism through a slider-crank mechanism or other conventional mechanical mechanism for converting rotary motion to linear motion. These drive systems require multiple bearings, grease or oil lubrication, rotational speed reduction by belts or gears from the driver, flywheels for stabilization of speed, protective safety guards and other mechanical devices, all of which add complexity and cost to the pumps. Moreover, in these traditional constructions the stroke length of the piston is fixed, as is the motion of the piston over time (e.g., generally sinusoidal motion) during each cycle of operation. This results in a peak piston velocity near mid-stroke, which determines the peak Bernoulli effect pressure reduction and kinetic head loss pressure reduction in the fluid that enters the pump on the suction stroke of the piston, thereby effecting the net positive suction head (NPSH) requirement.

Pumps are subject to mechanical damage from insufficient NPSH. In particular, vaporization of liquid at the point of entry into the pump results in vapor bubble formation. Subsequent compression of the vaporized liquid causes violent collapse of the bubbles, resulting in the formation of sonic shock waves that ultimately can damage pump components. Therefore, it is important that the available NPSH of a pump installation be sufficiently above the required NPSH of the pump.

Pump designs requiring a low NPSH allow greater flexibility in installation, often reducing installation costs. In addition, a lower required NPSH assures a greater margin to cavitation and hence greater reliability in operation when inlet operating conditions are off-specification.

The NPSH requirement for reciprocating pumps is dictated by factors tending to reduce the local entry suction pressure, such as liquid line acceleration pressure drop and velocity induced pressure drop (Bernoulli effect and kinetic head losses) in the inlet line and inlet valve. The cylinder and piston size, as well as the inlet valve size and peak piston velocity are critical factors in setting the minimum required NPSH. In particular, larger cylinder, piston and inlet valve size allow a slower pump speed. This results in a lower NPSH requirement. As stated earlier, pump designs requiring a low NPSH allow greater flexibility in installation and also a greater margin to cavitation, both highly desirable attributes.

Adjustment of the speed of traditional reciprocating pumps to reduce the throughput (i. e., flow turndown) is limited largely by the size of the pump flywheel and the size of the electric motor driver. Traditional reciprocating pumps are typically operated at a fixed motor supply power alternating current (AC) frequency and thus a fixed nominal pump speed. Adjustment of the alternating current electrical supply frequency to the motor, such as by the use of a variable frequency drive, to reduce pump speed is typically limited in turndown to 50% of full design pump speed and flow rate. The function of the pump flywheel is to minimize speed fluctuation or ripple during each stroke cycle of the pump. This is accomplished by absorbing and releasing kinetic energy between the pump shaft and the flywheel during each cycle; resulting in a cyclic speed fluctuation of the pump slightly above and below the nominal speed. This is called speed ripple. Speed ripple results in greater and lesser amounts of motor torque at various portions of each pump stroke cycle. This fluctuating torque creates fluctuating motor current draw, which in the extreme can be detrimental to the motor by thermal overheating. The key factor in determining peak motor current draw is the percentage of speed fluctuation. It should be noted that for a given flywheel size and motor size, the speed ripple percentage increases by the square of the ratio of design speed to reduced speed. Additionally, as motor speed decreases, the ability of the motor fan to properly cool the motor decreases as well. These factors combine to create the practical 50% turndown limit. Special measures can be taken to reduce this limit, such as providing a separately powered motor cooling fan, significantly over sizing the pump motor frame or over sizing the pump flywheel. However, these special measures are expensive alternatives. Other means to achieve reduced pump speed, such as variable sheaf diameter belt systems or other mechanical speed ratio adjustment methods, suffer from problems of increased wear, slippage and excessive peak load failures.

When a greater operational flow turndown is required, traditional pumps generally are operated in a recycle mode or in a cyclic on/off mode with a hold up tank. Recycle flow around the pump can be extremely wasteful in pump power and adds cost and complication by requiring a recycle line, a recycle valve, a cooler and means for control. The use of a hold up tank also increases the expense of the system, requires significant excess space and complicates operation and maintenance of the pump system.

A further deficiency associated with traditional reciprocating pumps resides in the need to provide an effective seal between the piston and the pump cylinder. Such a seal typically is provided by piston ring dynamic seals. However, even with the provision of such seals, some leakage is typically encountered, and in many applications represents a nuisance for disposing or recycling of the leaked material.

In traditional reciprocating pumps, piston ring wear is often the primary cause of pump repair maintenance. This results, in part, from sealing the full differential pressure between the pump discharge pressure and the piston backside leakage collection pressure, thereby causing these seals to wear quickly. Specifically, the backside pressure often is equal to or less than the pump inlet pressure, thereby creating a very significant pressure drop across the piston ring seals. This, in turn, increases the resulting piston ring wear rate.

Inlet and outlet valves on a reciprocating pump are typically fluid-activated check valves of specialty design to accommodate the high cyclic rate of the pump while achieving the longest possible operating life. Still, even with the specialty design of these valves, valve failure is often the reason for a pump malfunction. The design speed of the reciprocating pump is based on the required volumetric flow rate and the swept volume of the piston in the pump cylinder. Because a larger swept volume operating at a slower speed requires a larger physical pump size and a higher capital cost, it has been the practice to install a small pump operating at the highest speed permissible, as limited by reciprocating forces, piston ring wear rates and NPSH requirements. Such high speeds, typically in the range of 200 to 600 rpm, place a heavy burden on valve life.

It is desired to have a reciprocating pump that does not have the aforementioned drawbacks of traditional reciprocating pumps, and to actually enhance the positive aspects associated with traditional reciprocating pumps. The reciprocating pumps of the present invention minimize or eliminate traditional reciprocating design drawbacks, including: (1) maintenance of wearing parts, such as valves, piston rings and rod packings; (2) maintenance due to pump cavitation damage in low NPSH applications; (3) leakage of the pumped fluid from the process stream; (4) leakage of the pumped fluid to the pump surroundings; (5) high NPSH requirements for installation design; (6) lubrication contamination of the pumped liquid and pump surroundings; (7) high capital cost; (8) space requirements for installation and (9) hazards associated with exposed moving parts. With the present invention, the aforementioned drawbacks are either minimized or eliminated, while enhancing the positive features of traditional reciprocating pumps, such as high thermodynamic efficiency.

Beneficial aspects of the reciprocating pumps of the present invention that have not heretofore been available include: (1) variable flow from 0% to 100% of design flow rate at full design pressure, with improved efficiency; (2) lower heat leak in cold standby for cryogenic liquid pumping applications; and (3) increased output pressure capability at reduced speed.

Prior art attempts to improve the performance of reciprocating pumps have focused in three (3) areas; namely, modifying the size of traditional slider crank-driven reciprocating pumps, innovative developments in reciprocating cryogenic and/or hermetic pump designs, and converting to linear motor powered reciprocating designs.

With respect to modifying the sizing of traditional slider crank-driven reciprocating pumps, attempts have been made to increase the pump size to provide a swept volume greater than is conventionally considered to be necessary. Employing a bigger pump increases pump costs, but with the benefits of reducing wear-part maintenance by reducing the number of pump cycles required to deliver a predetermined flow, reducing maintenance costs resulting from insufficient NPSH damage, reducing installation costs to meet a high NPSH requirement (e.g., less tank elevation required), and increasing thermodynamic efficiency due to lower speed operation and reduced inlet and outlet valve pressure drop losses.

However, the above stated gains resulting from the use of a larger pump are achieved at the significant expense of: (1) higher pump capital cost; (2) increased fluid leakage from the pumped stream due to the larger piston diameter required to be sealed; (3) increased fluid leakage to the pump surroundings resulting from the larger diameter of the required rod seal; (4) increased general installation costs due to the use of larger-sized parts; (5) increased space requirements due to the use of larger sized parts; (6) increased cost of spare parts; and (7) increased cost of residual maintenance labor due to larger size and handling.

The balancing of the benefits and deficiencies enumerated above has generally resulted in a limitation on the extent of over sizing of reciprocating pumps.

Developments in cryogenic reciprocating pumps have included: (1) employing new dynamic seals, as disclosed in U.S. Pat. No. 4,792,289; (2) modifying the inlet and/or outlet valve designs, as disclosed in U.S. Pat. Nos. 4,792,289; 5,511,955 and 5,575,626; (3) reduced heat leak designs, as disclosed in U.S. Pat. Nos. 4,396,362 and 4,396,354; (4) introducing a second (or multiple) pre-compression chamber (s) for reduced NPSH requirement, as disclosed in U.S. Pat. Nos. 4,239,460; 5,511,955 and 5,575,626; and (5) introducing sub-cooling mechanisms for reducing the NPSH requirement and providing improved volumetric efficiency, as disclosed in U.S. Pat. Nos. 4,396,362; 4,396,354 and 5,511,955. However, none of the above enumerated improvements employ a hermetic design (i.e., no dynamic seals for the pumped liquid to prevent leakage to the ambient surroundings of the pumps).

U.S. Pat. No. 4,365,942 discloses a hermetic cryogenic pump including electrical coils that are maintained superconductive by virtue of the extreme cold temperature of the liquid helium to be pumped. While this design may be unique to the characteristics of liquid helium, it is not widely applicable for use in pumping other fluids.

As noted earlier, other prior art has suggested the use of a linear motor as a driver for a reciprocating pump. Application of this type of driver to a pump has suggested benefits in achieving compact size, reduction of power consumption, reduction of cost, reduction of maintenance and application to situations previously impossible to achieve with traditionally driven pump designs. The use of such linear motor drivers has proven to be applicable to both hermetic and non-hermetic pump designs. Linear motor-powered pumps have been disclosed for use in the down-hole pumping of oil and water, as disclosed in U.S. Pat. Nos. 4,350,478; 4,687,054; 5,179,306; 5,252,043; 5,409,356 and 5,734,209.

U.S. Pat. No. 4,687,054 discloses a wet air gap design that does not employ seals to separate the pumped liquid from the motor's air-gap between the stator and the armature.

U.S. Pat. Nos. 4,350,478; 5,179,306; 5,252,043 and 5,734,209 disclose the use of seals for protecting the motor air-gap from the pumped liquid. Many of the prior art seal designs have the air-gap filled with a lubricating and heat transfer oil. It should be recognized that virtually all of the aforementioned pumps operate fully submerged in the liquid that they pump, and therefore, achieving a hermetic seal to prevent leakage to their ambient surroundings, as desired in the preferred embodiments of the present invention, is a moot point.

Other electric linear motor-driven pumps employing a hermetic design have been disclosed for use in a number of applications, such as for blood pumping (U.S. Pat. No. 4,334,180), large volume, low pressure gas transfer applications (U.S. Pat. No. 4,518,317), a conceptual doubleacting pump design (U.S. Pat. No. 4,965,864) and non-hermetic designs employing conventional flat face linear motors (U.S. Pat. No. 5,083,905).

None of the aforementioned prior art teaches a hermetic pump design for intended industrial processes or product delivery applications having all of the benefits of the present invention.

As utilized throughout this application to describe the various embodiments of the invention, the term "swept volume" in reference to the dispensing chamber and/or the reservoir chamber, or in reference to the movement of the piston assembly, refers to the incremental change in volumes of the fluid-receiving regions of the dispensing chamber and reservoir chamber caused by movement of the piston assembly through either a dispensing stroke or a suction stroke. During the dispensing stroke of the piston assembly the volume of the fluid region of the dispensing chamber incrementally decreases by substantially the same amount that the volume of the fluid region of the reservoir chamber increases. During the suction stroke of the piston assembly the volume of the fluid region of the reservoir chamber incrementally decreases by substantially the same amount that the volume of the fluid region of the dispensing chamber increases. The above-discussed incremental decreases and increases in volume of the fluid regions of the dispensing chamber and reservoir chamber are equal to the incremental change in volume of the piston assembly within the dispensing chamber and reservoir chamber as the piston assembly moves through its dispensing stroke and suction stroke, respectively. When the sealing member between the cylinder and piston assembly is fixed against movement to the cylinder, the swept volume equals the traveled distance of the piston assembly moving through the sealing member (in either the dispensing or suction strokes) times (x) the cross-sectional area of that length of the piston assembly which passes through the sealing member.

Reference to "hermetic" or "hermetically sealed" in referring to the various pumps of this invention means pumps that are free of dynamic seals between the pumped fluid and the ambient surroundings of the pump. Dynamic seals are those seals between bodies that move relative to each other with a resulting sliding motion at the sealing point and function to prevent egress of a fluid from a pressurized area to an area of lesser pressure. As stated above, no such dynamic seals are included in hermetic pumps within the scope of this invention between the pumped fluid and the ambient surroundings of the pump.

BRIEF SUMMARY OF THE INVENTION

Reciprocating pumps for liquids include a cylinder having outer walls that provide a closed interior compartment having opposed ends. A piston assembly has a dispensing end and an opposed end, and this assembly is moveably mounted within the compartment for movement in opposed linear directions between the opposed ends of said compartment. A sealing member is provided between the piston assembly and the piston cylinder to maintain a dynamic fluid seal between the piston assembly and piston cylinder as the piston assembly moves within the closed interior compartment of the cylinder. The sealing member separates the interior compartment into a dispensing chamber and a reservoir chamber. A linear magnetic drive generates a linearly moving magnetic field for moving the piston assembly in opposed linear directions. A valve controlled inlet conduit communicates with the dispensing chamber of the interior compartment for directing liquid into the dispensing chamber to fill the volume of the dispensing chamber as the piston assembly moves through a swept volume in one linear direction through a liquid-receiving suction stroke. A valve controlled outlet conduit communicates with the dispensing chamber of the interior compartment for directing pumped liquid out of the dispensing chamber as the piston assembly is moved through the swept volume in a direction opposed to said one linear direction through a liquid dispensing stroke. An energy storage and release media cooperates with the piston assembly for storing energy as a result of the movement of the piston assembly through the suction stroke and for releasing the stored energy to said piston assembly as the piston assembly is moved through the dispensing stroke.

In the preferred embodiments of this invention, the pumps are hermetic pumps.

In a preferred embodiment of the invention, the energy storage and release media at least partially fills the reservoir chamber for storing energy therein as the piston assembly is moved through a swept volume of the reservoir chamber during the suction stroke of said piston assembly.

In the most preferred embodiments of this invention, the energy storage and release media are subject to elastic compression or expansion to store and release energy. Most preferably the energy storage and release media is a gaseous substance. When a gaseous substance is employed as the energy storage and release media it preferably at least partially fills the reservoir chamber of the cylinder. However, within the broadest aspects of this invention, liquid can be included in the reservoir chamber at a level such that that portion of the piston assembly in the reservoir chamber is completely within liquid. In fact, in certain embodiments of this invention the liquid can completely fill the reservoir chamber.

In a preferred embodiment of the invention, the magnetic drive is a poly-phase linear motor including an electronic power supply and a programmable microprocessor for controlling the operation of the power supply to adjustably control movement of the piston assembly.

Most preferably, the programmable microprocessor can adjustably control the operation of the power supply to adjustably control the characteristics of piston assembly motion such as the length of stroke of the piston assembly in each linear direction, the time period of such motion in each linear direction, the cyclic rate of reciprocation of the piston assembly and specifically the position, velocity and acceleration of the piston assembly throughout the entire path of movement of the assembly in the opposed linear directions, at every point in time of that cyclic motion. In addition, piston assembly motion can be controlled to include variable time length periods in which no motion is taking place. These periods of no motion can occur at any time or location within any cycle, or between cycles, as desired.

In one preferred form of the invention, the programmable microprocessor adjustably controls the time duration of each stroke of the piston assembly (e.g., the suction stroke and dispensing stroke) so that the time duration of one stroke (e.g., the suction stroke) is different from the time duration of the other stroke (e.g., the dispensing stroke). In a preferred manner of operating the pump the suction stroke is of a longer time duration than the dispensing stroke.

In another preferred form of the invention, the programmable microprocessor adjustably controls the cyclic movement of the piston assembly so that it either is continuous or discontinuous. That is, the operation of the pump can be controlled so that a pause in motion of any desired time duration is provided at any one of various locations within any cycle of the piston assembly, or between successive cycles of the piston assembly; each cycle including one suction stroke and one dispensing stroke.

In a preferred embodiment of this invention, the piston includes a position sensor that provides an electrical feedback signal to the programmable microprocessor of the magnetic drive system.

In the most preferred embodiment of this invention, the linear magnetic drive includes a stator and armature, with the stator being located adjacent and outside of the pump cylinder and the armature being located on the piston assembly inside of the cylinder.

In a preferred embodiment of the invention, wherein the energy storage and release media is a gaseous substance, an additional mechanical energy storage and release media (e.g., a spring, bellows, etc.) can be employed for assisting in the storage of energy derived from motion of the piston assembly in one linear direction and for releasing, or imparting, the stored energy to the piston assembly during subsequent motion of the piston assembly in a linear direction opposed to one said linear direction.

In a preferred embodiment of this invention, a liquid sump is provided in communication with a valve-controlled inlet conduit for supplying liquid to the pump.

Most preferably, when a liquid sump is provided it is partially filled with the liquid to be pumped and includes a ullage space with an elastic compressible and expansible media (e.g., a gas) therein to minimize pulsation of liquid flow to the pump (i.e., permit delivery of liquid to the sump at a substantially constant flow rate) in spite of the fact that the liquid being drawn into the pump is at a non-constant, pulsating flow rate.

For some applications, the ullage space includes a thermal anti-convection and anti-conduction insulator material, and, optionally, a thermally conductive element is provided for assisting in maintaining the surface of the liquid in the sump at a desired elevation.

Most preferably, the sump includes a vent line, a valve and liquid float for operating the valve to maintain the liquid in the sump at a desired elevation.

In the preferred embodiment of the invention, a conduit is provided for connecting the discharge from the pump to a bottom wall section of the sump through a removable and sealed connection.

In another embodiment of the invention, a conduit is provided for connecting the discharge from the pump through the sump ullage space.

In accordance with this invention, the liquid sump can be completely filled with the liquid being pumped so as to eliminate any ullage space for receiving an elastic and expansible media. In this embodiment of the invention, an additional elastic compressible and extensible media, e.g., a liquid-filled flexible bellows or diaphragm accumulator, is maintained in communication with the interior of the sump to minimize pulsation of liquid delivered to the sump, i.e., provide for a substantially constant flow rate of liquid into the sump.

In certain embodiments of this invention, the gas constituting the energy storage and release media in the reservoir chamber of the pump interior compartment is non-condensible, and is not a vapor of the liquid being pumped, and the pump includes means for supplying and discharging controlled amounts of the non-condensible gas to the pump.

In other embodiments, the gas constituting the energy storage and release media in the reservoir chamber of the pump interior compartment is partially composed of vapor of the liquid being pumped and partially composed of a non-condensible gas that is not a vapor of the liquid being pumped, and the pump includes means for supplying and discharging controlled amounts of said non-condensible gas to the pump. For some applications, the gas can be composed solely of the vapor of the liquid being pumped.

In a preferred embodiment of the invention, the pump is employed for pumping a liquefied gas, which may be a cryogenically liquified gas, and the cylinder includes heat-insulating means in the region of the dispensing chamber to maintain the liquid at a desired, cold temperature, and heating means in the region of the reservoir chamber to maintain the gas in this latter region at a desired warm temperature and the pressure of the gas in the region of the reservoir chamber is maintained below the critical pressure of the gas.

However, it should be understood that in accordance with the broadest aspects of this invention the pumps can be operated with the pressure of the gas in the reservoir chamber at or above the critical pressure of the gas.

In another embodiment of this invention, the reservoir chamber of the pump chamber includes a bellows section therein, and the energy storage and release media communicates with the bellows section such that the bellows sections is moved in response to the suction stroke of the piston assembly to store energy in said energy storage and release media.

In a preferred embodiment of the invention, the bellows section is an end section of the reservoir chamber and the energy storage and release media (e.g., a spring) engages an outer wall of the bellows section. In this embodiment the bellows section of the reservoir chamber can be filled with a liquid.

In a preferred embodiment of this invention a bellows member is located in the reservoir chamber and the energy storage and release media is a gaseous substance filling said bellows section.

A method for pumping a liquid in accordance with this invention includes the steps of providing a pump having a piston assembly mounted for reciprocating movement in a closed interior compartment of a piston cylinder having opposed closed ends, the piston assembly including a dispensing end and an opposed end; generating a linearly moving magnetic field for reciprocating the piston assembly within the cylinder through a dispensing stroke and a suction stroke, respectively, providing a sealing member between the piston assembly and piston cylinder to maintain a dynamic fluid seal between the piston assembly and piston cylinder during the dispensing and return strokes of said piston assembly, said seal dividing the interior compartment into a dispensing chamber and a reservoir chamber; introducing liquid to be pumped into the dispensing chamber; maintaining the liquid in the cylinder at a level such that a lower surface of the sealing member and the dispensing end of the piston assembly are maintained within the liquid throughout the length of the dispensing and suction strokes of the piston assembly and providing an energy storage and release media in a location for storing energy when the piston assembly is moved through the suction stroke and for imparting the stored energy to the piston assembly as the piston assembly is moved through the dispensing stroke.

In accordance with the preferred method of this invention, the energy storage and release media is provided in the reservoir chamber of the interior compartment.

In accordance with a preferred method of this invention, the energy storage and release media is a gaseous substance, and most preferably fills the reservoir chamber to a level such that the opposed end of the piston assembly (i.e., the end opposite the dispensing end) is in the gaseous volume during the entire dispensing and suction strokes of the piston assembly.

In the preferred method including a gaseous substance as the energy storage and release media, a liquid/vapor interface between the liquid to be dispensed and the gaseous substance is established and maintained at an elevation in which the sealing member is fully submerged within the liquid during the operation of the pump.

In accordance with the preferred methods of this invention, the step of generating the linearly moving magnetic field is provided by an electronic power supply controlled by a programmable microprocessor.

A preferred method of this invention includes the steps of determining the position of the piston assembly within the cylinder and controlling the linearly moving magnetic field in response to that determination.

A preferred method of this invention includes the steps of generating the linearly moving magnetic field with a linear magnetic drive employing a stator and armature, with the stator being located adjacent and outside of the piston cylinder of the pump and the armature being located on the piston assembly inside the piston cylinder to thereby create an air-gap between the inner surface of the stator and the outer surface of the armature in which the outer wall of the piston cylinder is disposed.

A preferred method of this invention includes the step of employing both a gaseous substance and an additional mechanical media for storing energy derived from motion of the piston assembly in either the dispensing stroke or the suction stroke, and then imparting the stored energy to the piston assembly during the other stroke of the piston assembly.

In accordance with one method of this invention, the gaseous substance in the reservoir chamber is non-condensible and is not a vapor of the liquid being pumped, and the method includes the steps of supplying and discharging controlled amounts of non-condensible gas to the pump.

In accordance with one method of this invention, the gaseous substance in the reservoir chamber is a vapor of the liquid being pumped.

In accordance with another aspect of the method of this invention, the gaseous substance in the reservoir chamber is partially composed of vapor from the liquid being pumped and is partially composed of a non-condensible gas that is not a vapor of the liquid being pumped, and this method includes the steps of supplying and discharging controlled amounts of non-condensible gas to the pump.

A preferred method of this invention includes the step of modulating the linearly moving magnetic field during the pumping operation to vary the motion of the piston assembly.

The preferred method of varying the motion of the piston assembly includes the step of varying one or more of the length of stroke of the piston assembly, the cyclic rate of reciprocation of the piston assembly, the position of the piston assembly, the velocity of the piston assembly and the acceleration of the piston assembly.

A preferred method of this invention includes the step of providing liquid to be pumped into the piston cylinder from a liquid sump. Most preferably, in this embodiment of the invention, the method includes the step of maintaining the liquid level in the sump at a desired elevation.

A preferred method of this invention in which a liquid sump is employed includes the step of only partially filling the sump with the liquid to be pumped and including a compressible media in the ullage space within the sump.

In accordance with another aspect of the method of this invention, the sump is substantially completely filled with a liquid to be dispensed and an accumulator, e.g., a flexible bellows or diaphragm, or other media is provided for minimizing the flow pulsation of liquid being directed into the sump.

A preferred method of this invention includes the step of insulating the cylinder of the pump in a region of the dispensing chamber to maintain the liquid to be pumped at a desired cold temperature and heating a region of the reservoir chamber to maintain said region of said reservoir chamber at a desired warm temperature to maintain at least a portion of the reservoir chamber volume in a gaseous state. Most preferably the pressure of the gas in the reservoir chamber is maintained below the critical pressure of the gas; however, it is within the broadest aspects of this invention to operate with the gas pressure at or above the critical pressure of the gas. This method is particularly useful in the pumping of liquefied gas, and more particularly, cryogenically liquefied gas.

In accordance with one method of this invention, a bellows section is provided in said reservoir chamber in communication with energy storage and release media such that movement of the piston assembly through the suction stroke moves the bellows section to store energy in the energy storage and release media.

In a preferred form of this latter method, the bellows section is an end section of the reservoir chamber and the energy storage and release media (e.g., a spring) communicates with said bellows section. In this embodiment of the invention the bellows section can be completely filled with a liquid.

In one embodiment of a method in accordance with this invention, the bellows section is located inside the reservoir chamber and is filled with a gaseous substance, said gaseous substance being said energy storage and release media.

DETAILED DESCRIPTION OF THE INVENTION

Figure 1:
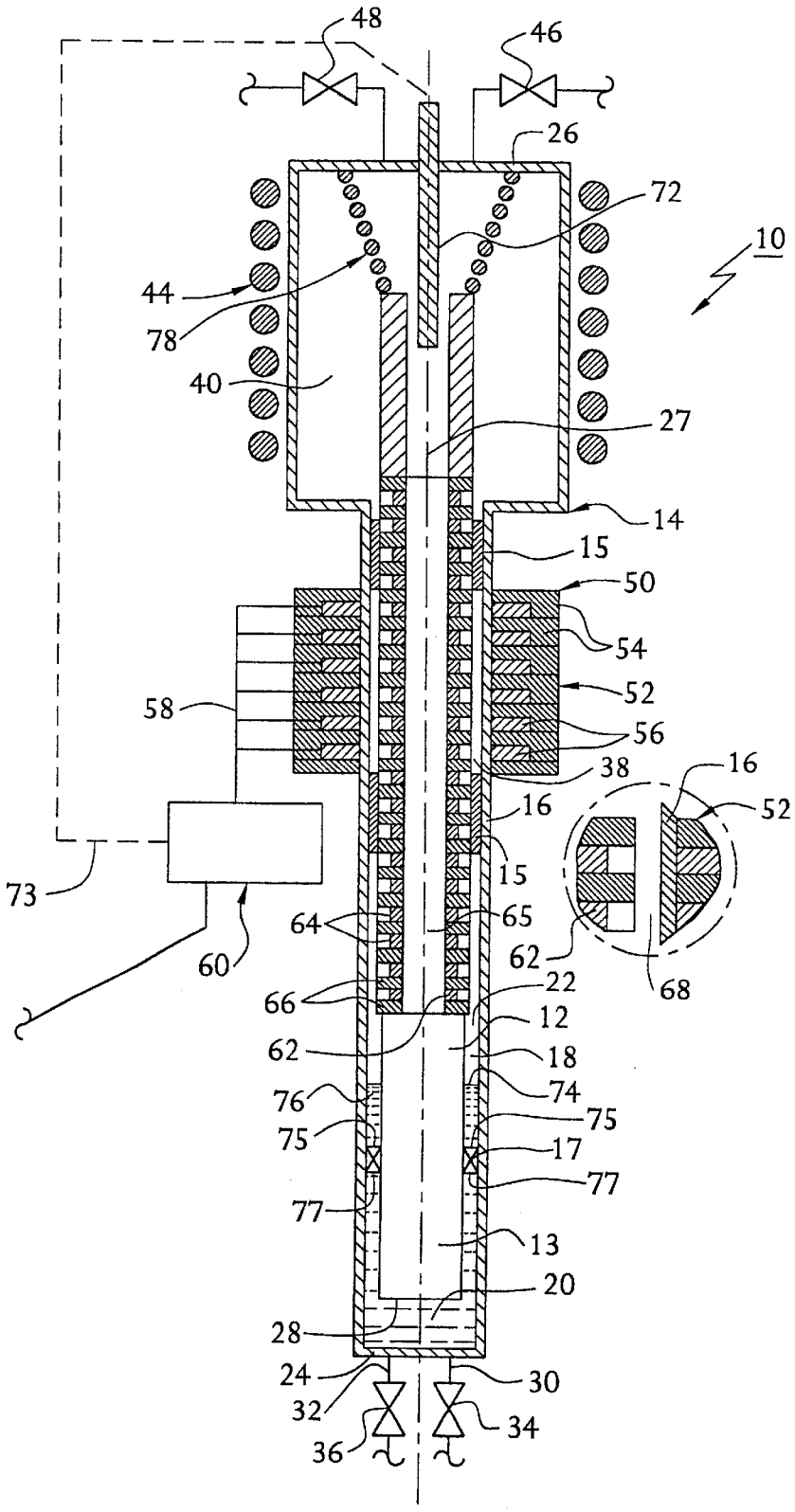
FIG. 1 is a schematic, sectional view of one embodiment of a hermetic reciprocating pump of this invention including, in an enlarged view, a portion of the linear magnetic drive.

A reciprocating pump in accordance with a preferred embodiment of this invention is generally shown at 10 in FIG. 1. The pump 10 is a hermetic pump including a piston assembly 12 located in a mating cylinder 14. The piston assembly 12 includes a piston 13, and the cylinder 14 includes outer walls 16 providing a closed interior compartment 18 in which the piston assembly 12 is movably retained. Bushings 15 are provided for supporting the piston assembly 12 from the inner surface of the outer wall 16 of the cylinder 14 while permitting free motion of the piston assembly within the closed interior compartment 18 of said cylinder. The bushings 15 are fabricated from a material with a low friction coefficient and acceptable wear performance, such as a composite-filled Teflon or other polymer material providing a dry lubricant transfer film to the opposed sliding surface. The use of these latter materials eliminates the need for employing a separate liquid lubricant with the bushings. The bushings 15 may be mounted to the cylinder wall or piston assembly, as desired.

A piston sealing member 17 is interposed between the outer surface of the piston 13 and the inside surface of the cylinder 14 to divide the closed interior compartment 18 into a dispensing chamber 20 and a reservoir chamber 22. This optimizes pumping efficiency by effectively minimizing liquid leakage passed the piston sealing member 17 during downward and upward movement of the piston assembly 12 through dispensing and return strokes, respectively. A suitable design to provide this sealing function will be obvious to a practitioner skilled in the art and therefore does not constitute a limitation on the broadest aspects of this invention. For example, the sealing function can be provided by configurations such as piston rings, labyrinth seals, segmented piston rod type seals or other well known sealing devices. Moreover, sealing devices may be designed to be mounted on either the piston 13, the cylinder 14, or on both of these latter-two members. In the preferred embodiment, the piston sealing member 17 is stationary and is mounted on the inner wall of the cylinder 14 in the region in which the piston 13 moves, to thereby provide an effective seal between the piston and the inner wall of the cylinder during the entire reciprocating stroke of the piston assembly 12. It is recognized that the piston sealing member 17 is a dynamic seal, and as such will operate with some small controlled liquid leakage passed it as dictated by the direction and amount of differential pressure imposed across it.

Still referring to FIG. 1, the cylinder 14 is closed at its opposed ends 24, 26 and the piston assembly 12 is mounted for reciprocating movement along central axis 27 of the piston assembly 12 and mating cylinder 14.

As can be seen in FIG. 1, the liquid to be pumped enters into and discharges from the dispensing chamber 20 of the cylinder, preferably in a region below distal end 28 of the piston assembly 12. Specifically, pumped liquid enters the closed end 24 of the compartment 18 through inlet conduit 30 and exits the closed end through outlet conduit 32.

Inlet and outlet flow from the interior compartment 18 of the cylinder is controlled by inlet valve 34 and outlet valve 36, respectively.

Preferably, the reservoir chamber 22 includes a lower section 38 having a cross-sectional area corresponding to that of the dispensing chamber 20, and an upper, enlarged section 40 of greater cross-sectional area.

In the preferred embodiment of this invention, the upper region of the upper, enlarged section 40 of the reservoir chamber 22 that is above the top of the piston assembly 12 during the entire length of the dispensing and suction strokes of said piston assembly is either partially or fully filled with a gaseous substance. In the most preferred embodiment, the upper region is fully filled with a gaseous substance; however, when said upper region is only partially filled with a gaseous substance the remainder of said upper region may be occupied by a generally fixed volume of reserve liquid.

In accordance with this invention, the gaseous substance may include a vapor phase of the liquid to be pumped, or a different non-condensible gas, or a mixture of the two. The gaseous substance in the upper region of the enlarged section 40 of the reservoir chamber 22 above the piston assembly 12 provides a degree of elastic compressibility and expansibility, which minimizes pressure changes above the piston assembly 12 throughout each piston assembly reciprocation cycle.

Still referring to FIG. 1, the upper, enlarged section 40 is sized and shaped to minimize pressure changes in the upper volume during each cycle of the reciprocating piston assembly motion. Most preferably, the temperature of the gaseous substance above the piston assembly 12 is controlled by a heat transfer means 44 to maintain the proper gas volume and pressure within the upper section 40. The particular heat transfer means that is employed does not constitute a limitation on the broadest aspects of the present invention, and can include any one of a number of different heat transfer sources that are generally known and obvious to persons skilled in the art. For example, the heat transfer means 44 can include electrical heating elements, coils of a circulating fluid, ambient convection systems, etc. If desired, or required, a gas input valve 46 for controlling the flow of the gaseous substance into the upper section 40 of the reservoir chamber 22 of the cylinder 14, and a gas removal valve 48 for controlling the removal of the gaseous substance from said upper section may be employed, based on the specifications of the liquid being pumped, such as the liquid temperature, pressure and vapor pressure.

Still referring to FIG. 1, the pump 10 includes a linear magnetic drive system generally indicated at 50. The drive system 50 includes a stator 52 that is closely adjacent to the outer wall 16 of mating cylinder 14, outside of the closed interior compartment 18 housing the piston assembly 12. The stator 52 is the source of magnetic force applied to the piston assembly 12 to effect reciprocating movement of said assembly. The stator 52 is constructed of a plurality of magnetically soft pole pieces 54 (preferably constructed of iron) and a plurality of coiled wire windings 56 (preferably provided by insulated copper). Both the soft pole pieces and coiled wire windings are generally annular in shape, and are stacked alternately along the central axis of the stator 52.

The stator 52 creates a linearly moving magnetic field in the direction of reciprocating motion of the piston assembly 12, and this moving magnetic field is created by modulation of electrical current directed to the coiled wire windings 56 through electrical conductors 58 connected to an electronics and power supply package 60 of any well known design. The electronics and power supply package 60, under the control of a software program forming part of an external microprocessor (not shown) of conventional design creates a modulated control of voltage and frequency for the electric current to the windings of the stator, to thereby create a linearly moving magnetic field to reciprocate the piston assembly 12 in opposed linear directions within the closed interior compartment 18 of the cylinder 14. In particular, the modulated magnetic field of the stator 52 reacts with an armature 62 that constitutes a portion of the piston assembly 12.

Still referring to FIG. 1, the armature 62 is composed of a plurality of permanent magnets 64 and a plurality of magnetically soft pole pieces 66 (preferably of iron). The permanent magnets 64 and the pole pieces 66 are generally annular in shape and are stacked alternately over a center arbor 65 along the center line axis of the armature. The stator 52 and the armature 62 comprise a poly-phase linear motor, and the interaction of the static magnetic fields of the armature magnets and the dynamic stator magnetic field creates the driving force for reciprocating the piston assembly 12 within the interior compartment 18 of the cylinder 14.

As noted, in the preferred embodiment of the pump 10, the stator 52 is mounted coaxially with the cylinder 14 and external to the outer wall 16 thereof. Thus, the stator is not wetted by the liquid being pumped or by the gas contained within the top section 40 of the cylinder 14 above the piston assembly 12. The annular gap between the outside diameter of the armature 62 and the inside diameter of the stator 52 through which the magnetic lines of force are concentrated is known as the "air gap," which is illustrated at 68 in the fragmentary enlarged view of the stator 52 and armature 62 shown in FIG. 1. In this arrangement, the outer cylinder wall 16 is located in the air gap 68, and therefore is fabricated of a non-magnetic material.

In an alternative arrangement (not illustrated), the stator 52 may be mounted inside the cylinder pressure boundary. However, this arrangement is less preferred because it exposes the stator 52 to the pump liquid and/or the upper volume of gas 40 within the interior compartment 18 of the cylinder 14. In view of such exposure, material compatibility must be established between the stator components and these fluids (i.e., stator with liquid and stator with gas) and requires that pressure containment be included in the design of the stator 52.

As can be seen at the upper end of the pump 10, a magnetostrictive-type position feedback sensor 72 is mounted in a non-contacting relationship adjacent to the piston assembly 12 to provide an electrical feedback signal, schematically indicated at 73, representative of the position and velocity of piston 13. This feedback signal 73 is directed to the electronics and power supply control package 60, which then modulates the voltage and frequency of the current directed through the electrical conductors 58 to the stator windings 56. Employing this feedback or "closed loop" system is preferred in this invention, since the feedback signal enhances the performance of the magnetic driving system. However, it should be understood that employing a feedback system is not mandatory, and an "open loop" mode of operation without a position feedback system also can be employed in accordance with the broadest aspects of this invention.

As illustrated, the pump 10 is shown in a substantially vertical orientation, which is most preferred. However, deviation from this vertical orientation is permitted to some degree, as long as a relatively distinct interface 74 is maintained between the liquid and gas phases of the interior compartment 18 of the cylinder, and that interface exists in the reservoir chamber 22 at an elevation distinctly above the piston sealing member 17. In particular, an orientation of the pump operating axis 27 that approaches horizontal creates a risk of loss of gas from the reservoir chamber 22 of the interior compartment 18 to the dispensing chamber 20 below the piston sealing member 17 and ultimately to the working swept volume traversed by the piston 13. This loss of gas can be initiated by an agitated mixing of these two fluids (gas and liquid) immediately above the piston sealing member 17. Mixing above the piston sealing member 17 occurs due to the motion of the piston assembly 12 and the action of the fluids due to their relative buoyancy. Downward leakage of this gas and liquid mixture passed the sealing member 17 will result as the pressure differential across said sealing member is disposed for fluid leakage in that direction. Any gas leakage into the region of the dispensing chamber 20 below the piston 13 will exit in the pump discharge stream. Such a gas loss necessitates gas replenishment to the upper section 40 of the reservoir chamber 22, which complicates operational control of the pump. The permissible degree of deviation of the pump operating axis 27 from its vertical orientation is a function of the relative density ratio of the liquid being pumped to that of the gas in the upper section 40 of the reservoir chamber 22, as well as other variables, such as the length of the stroke of the piston assembly and the cyclic speed of that stroke. A precise limitation as to the permitted angular orientation relative to vertical cannot be stated, due to the number of factors involved in establishing such a limitation. However, it should be noted that if the pump 10 is mounted in a moving installation subject to momentary, or cyclic accelerations, such accelerations need to be added vectorially to the acceleration of gravity to further limit the permissible deviation of the pump operating axis 27 from vertical.

In the most preferred mode of operation, the nominal liquid/gas interface 74 is maintained distinctly above the sealing member 17 during the entire reciprocating stroke of the piston, i.e., both the upper side 75 and the lower side 77 of the sealing member 17 remain solely within the liquid phase as the piston 13 is reciprocated between its proximal (upper) and distal (lower) limits of reciprocation. The important feature is to preclude the gaseous substance within the reservoir chamber 22 of the cylinder 14 from moving passed the sealing member 17 into the liquid being pumped from the dispensing chamber 20. This is achieved by maintaining at least the lower side 77 of the sealing member 17 within the liquid phase as the piston 13 is reciprocated in a dispensing stroke between its proximal and distal limits of reciprocation.

The optimum location of the interface 74 is dependent on the actual specifications of the liquid being pumped. In particular, temperature requirements for the liquid being pumped from the dispensing chamber 22 and for the gaseous substance in the upper section 40 of the reservoir chamber 22, relative to the acceptable operating temperature limits of the stator 52 and the armature 62, are critical factors that need to be taken into account in properly designing the location of the liquid/gas interface 74 along the length of the piston assembly 12.

It is important that the pressure of the gas and liquid within the reservoir chamber 22 be maintained at a level to assure that the net liquid leakage past the piston sealing member 17 during each cycle of reciprocating motion is substantially zero. Specifically, on a downward, or liquid dispensing stroke of the piston assembly 12, leakage past the piston sealing member 17 is upward, while on an upward or retracting stroke (suction) of the piston assembly the leakage is downward, drawing on the leakage reservoir of liquid 76 existing above the piston sealing member 17 during the entire upward stroke of the piston 13.

The particular height or volume of the leakage reservoir of liquid 76 in the reservoir chamber 22 is not strictly constant, but does fluctuate somewhat through the progress of each reciprocating cycle of the piston assembly 12. A zero net piston leakage in each cycle results in a time average liquid/gas interface level that is neither rising nor falling, i.e., an average level that remains substantially constant in height. Of course, the instantaneous elevation of the liquid/gas interface 74 will rise and fall nominally due to fluctuating leakage passed the piston sealing member 17 as a result of the reciprocating motion of the piston assembly 12 through its stroke length and the resultant fluctuating pressure differential across said sealing member. However, as stated previously, the time average liquid/gas interface level 74 is neither rising nor falling.

Control of the pressure of the gaseous substance in the upper section 40 of the reservoir chamber 22 to achieve zero net leakage of liquid past the piston sealing member 17 may be accomplished by several means. In particular, the pressure is controlled to a level approximately mid-way between the liquid inlet pressure and the liquid outlet pressure of the pump. Variance in the pressure of the gaseous substance in the upper section 40 of the reservoir chamber 22 affects the rate of liquid leakage past the piston sealing member 17. This leakage will occur at potentially different rates in the upward and downward directions as the piston assembly 12 moves downward and upward, respectively. The pressure of the gaseous substance in the upper section 40 of the reservoir chamber 22 and the pressure in the dispensing chamber 20 as the piston assembly 12 moves through the swept volume serve to define the differential pressure driving liquid leakage past the piston sealing member 17 at all points in the motion of the piston assembly 12. Given that the pressure in the swept volume of the dispensing chamber 20 is fixed by the process application of the pump, the pressure of the gaseous volume in the upper section 40 of the reservoir chamber 22 is controlled to adjust the upward and downward liquid leakage rates past the piston sealing member 17 to achieve the condition of nominally zero net leakage during each full reciprocating cycle of the piston assembly 12. Liquid leakage passed the piston sealing member 17 is in the direction of high-to-low pressure differential across the piston sealing member and the amount of said leakage increases with the increasing pressure differential across said sealing member.

The gaseous substance existing in the upper section 40 of the reservoir chamber 22 above the piston assembly 12 has an energy storing function. In particular, upward motion of the piston assembly 12 through its suction stroke requires little magnetic work input to draw low pressure liquid into the swept volume of the dispensing chamber 20 below the piston 13; however, the pressure differential across the piston assembly 12 requires a notable input of magnetic work energy from the linear magnetic drive system 50 during the upward motion of the piston assembly 12. On the subsequent downward, or dispensing stroke, the high pressure developed on the pumped liquid below the piston 13, as the liquid discharges through outlet valve 36, requires significant work input. The work input provided during the downward, or dispensing stroke of the piston 13 is provided partially by the magnetic force lines between the armature 62 and the stator 52, and the remainder of the work is provided by the re-expansion of the compressed gaseous substance in the upper section 40 of the reservoir chamber 22. Magnetic energy input during the up stroke of the piston assembly 12 that is stored in the gaseous substance in the upper section 40 of the reservoir chamber 22 as pressure/volume energy is released back to the piston assembly 12 during the downstroke. This permits a nominally equal loading of the magnetic driving system 50 on both the upward and downward strokes of the piston assembly 12.

In an alternative embodiment, a storage of potential energy during the upward, or retracting suction stroke of the piston assembly 12 can be achieved by a compression spring 78, either with our without a gaseous substance, acting between the upper inner end surface of the cylinder 14 and the upper or proximal end surface of the piston assembly 12. It also is within the scope of this invention to use some other mechanical, electrical or magnetic energy storage component in place of, or in addition to the compressed gaseous substance described heretofore. However, the use of these alternative storage devices is not as preferred as employing the gaseous substance in the upper section 40 of the reservoir chamber 22, due to the fact that inclusion of these added elements create added complications.

It should be noted that the pump 10 in accordance with the most preferred embodiment of the invention is configured to eliminate all dynamic seals between the pumped liquid and the ambient surroundings of the pump, to thereby provide a hermetically sealed construction.

The dynamic seals employed in prior art devices act to prevent egress of a fluid from a pressurized area to an ambient area of lesser pressure, between bodies that usually contain the pressurized fluid and are in motion relative to each other. In traditional reciprocating pumps, the stationary body typically is a pump housing seal and the moving body is a piston rod. The piston rod enters the pump housing to deliver mechanical work to the fluid. The use of such dynamic seals is eliminated from the hermetically sealed variants of the present invention. However, in accordance with the broadest aspects of this invention the reciprocating pumps are not required to be hermetic pumps.

The reciprocating piston assembly 12 is driven by magnetic lines of force, which are produced by electromagnetic means, as described above. In particular, motion of the piston assembly 12 is made to occur by modulating multiple external magnetic fields. The modulation of the external magnetic fields is accomplished by modulation of the electrical currents producing the magnetic fields and this modulation permits variable control of the piston assembly motion, which includes variable and adjustable control of the length of the linear stroke of the piston assembly, the cyclic frequency of the piston assembly, as well as the position, velocity and acceleration of the piston assembly throughout the entire path of movement of the assembly in the opposed linear directions at every point in time of that cyclic motion.

In a preferred mode of operation, the linear motor is operated to provide different time periods for completing the suction stroke and the delivery stroke of the piston assembly 12, respectively; with the suction stroke preferably being slower than the delivery stroke.

In another preferred mode of operation the programmable microprocessor adjustably controls the cyclic movement of the piston assembly so that it either is continuous or discontinuous. That is, the operation of the pump can be controlled so that a pause in motion of any desired time duration is provided at various locations within any cycle of the piston assembly, or between successive cycles of the piston assembly; each cycle including one suction and dispensing stroke.

As noted earlier in this application, in accordance with the broadest aspects of this invention the linear motor, through the programmable controller, can be employed to vary a number of different attributes of the piston assembly motion.

Figure 2:
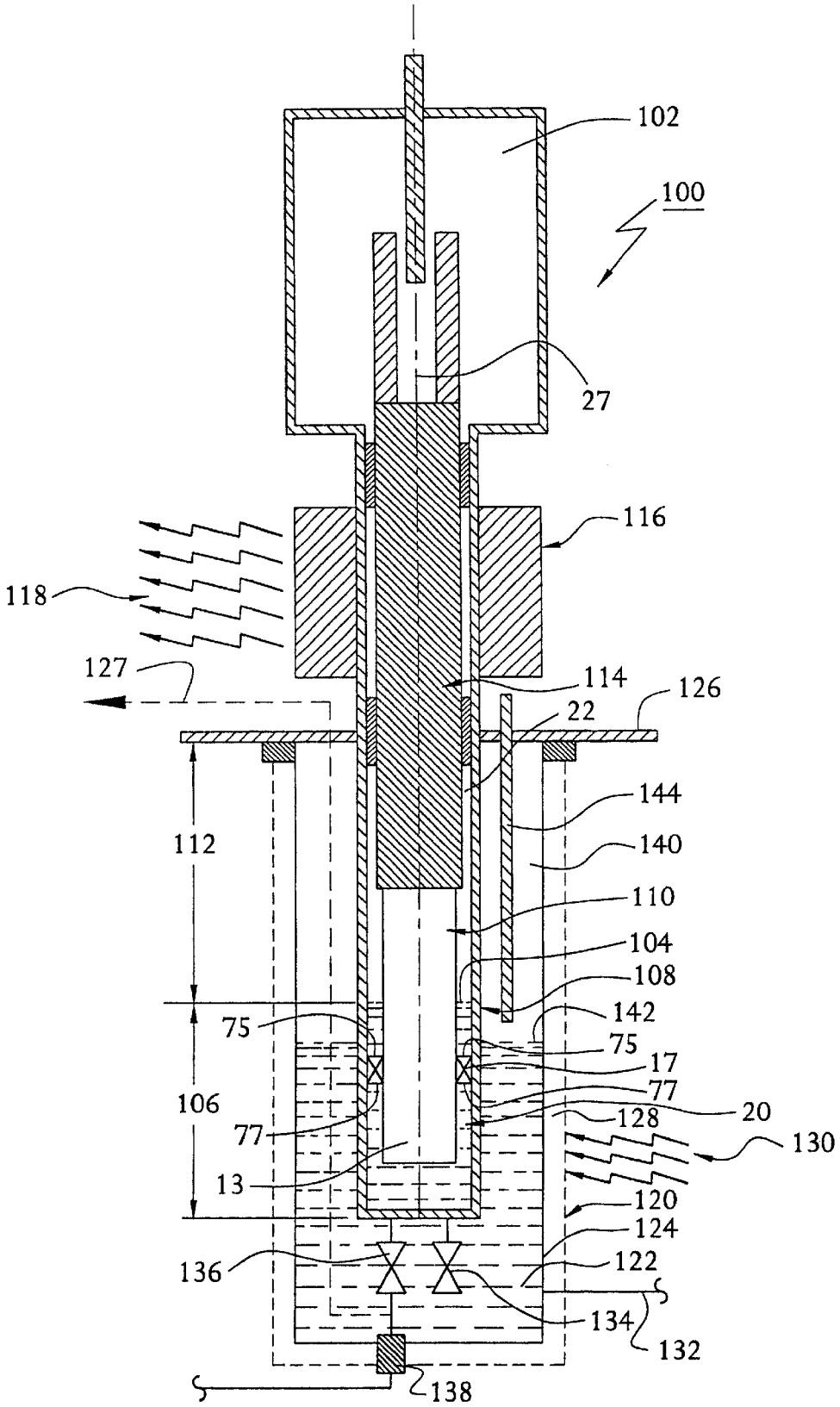
FIG. 2 is a schematic, sectional view of another embodiment of a hermetic reciprocating pump in accordance with this invention.

Referring to FIG. 2, a second embodiment of a hermetic reciprocating pump in accordance with this invention is illustrated at 100.

The hermetic reciprocating pump 100 is specially designed for pumping liquids that are below ambient temperature, and which exist only in a vapor state at ambient temperature, (e.g., liquefied industrial gases, typically, nitrogen, oxygen, argon, hydrogen, helium, methane, etc.). In this construction, the preferred method for controlling gas pressure in the upper section 102 of reservoir chamber 22 above the piston sealing member 17 is by boiling off of the liquid phase being pumped. This results in the upper section 102 of the reservoir chamber 22 being filled substantially completely with the vapor phase of the liquid being pumped. If there is excessive vapor inventory in the upper section 102 of the reservoir chamber 22, the liquid/vapor interface 104 is relocated downward toward the cryogenic temperature end 106 of the closed cylinder 10 8 and the reciprocating piston assembly 110. This exposes a portion of the vapor inventory to colder surface temperatures at the lower end of the thermal gradient region 112. This induces re-condensation, which, in turn, causes a reduction in the vapor inventory and restores the liquid/vapor interface 104 upwardly.

Conversely, if there is an insufficient vapor inventory in the upper section 102, the liquid/vapor interface 104 will automatically rise, thereby exposing the liquid phase above the piston sealing member 17 to warmer surface temperatures in the thermal gradient region 112. This will cause vaporization of the liquid, thereby replenishing the vapor inventory in the upper section 102.

From the above explanation, it should be apparent that the control of the vapor inventory in the upper volume 102 of the pump 100 is based upon control of the thermal gradient along the length of the closed cylinder 108 and the piston assembly 110 therein.

In those cases where the gaseous substance in the upper section 102 is fully or largely constituted by vapor from the liquid being pumped, and the pressure above the piston assembly 110 is above the critical pressure of the liquid being pumped, a distinct liquid/vapor interface surface will not exist. Specifically, above this critical pressure a gradient of decreasing fluid density in the thermal gradient direction of increasing temperature of the fluid will exist. In this latter situation, a mixing of the cold and denser "liquid-like fluid" with the warmer and less dense "gas-like fluid" affects the operation of the pump. Accommodations in pump design must be made to deal with this problem, such as increasing the length of the thermal gradient between the liquid-like and gas-like zones to assure minimal mixing of these fluids, acceptable heat transfer by conduction and acceptable heat transfer by residual mixing in stable temperature profiles throughout.

It should be noted that the "critical pressure" referred to above is that pressure of a fluid at which there is no distinct separation of liquid and gaseous phases at any temperature. Below this critical pressure a distinct condition of condensation from gas to liquid phase will occur at the liquefaction temperature (also known as the boiling temperature) and a liquid/vapor interface will exist.

The armature 114 and the stator 116 of the linear magnetic drive (which are schematically illustrated in FIG. 2, but can be identical in construction to the armature 62 and stator 52 employed in the pump 10) preferably operate at somewhat above ambient temperature to allow heat (illustrated by wavy arrows 118 in FIG. 2) generated by electrical resistive and eddy current losses to be rejected to the ambient surroundings and not to the pumped liquid. It should be noted that heat input to the cryogenic liquid decreases thermodynamic pump efficiency and increases the requirements for NPSH in the incoming fluid.

Although omitted from FIG. 2, it should be understood that the magnetic drive system employed in the pump 100 can be identical to the linear magnetic drive system 50 employed in the pump 10. That is, the linear magnetic drive system employed in the pump 100 can include, in addition to an armature and stator construction substantially identical to the armature 62 and stator 52 employed in the pump 10, an external microprocessor controlled electronics and power supply package substantially identical to the electronics and power supply package 60 employed in the pump 10. Moreover, the control of the electrical output of the package in the pump 100 can be the same as the control of the electrical output of the package 60 in the pump 10; preferably by a software program. In addition, the drive system employed in the pump 100 can include a position feedback system of the same type that is employed in the pump 10.

As noted earlier in this application, NPSH is the difference between the inlet liquid static pressure and the vapor pressure of that liquid at the inlet temperature, expressed in terms of height of standing liquid. Insufficient NPSH results in liquid boiling in a pump inlet section. Bubbles of vapor resulting from the boiling action subsequently collapse violently during pressurization in the pumping process, resulting in acoustically transmitted shock waves in the liquid. This can cause damage to the pump's mechanical components. Therefore, it should be understood that a pump design with a low required NPSH is desirable to allow pumping from vessels with low liquid levels, and thus, low available NPSH.

The dispensing chamber 20 below the piston sealing member 17 must be maintained at a cryogenic temperature to establish the required thermal gradient in the pump for properly controlling the liquid/vapor interface level 104. The suction of the pump 100 can be applied directly to a cryogenic liquid inlet supply line (not shown) or from a cryogenic inlet sump 120. Use of a sump is preferred where the amount of sub-cooling of the inlet liquid 122 is low. The amount of "sub-cooling" as referred to in this application means the different between the temperature of the inlet liquid and the boiling temperature of that liquid at the inlet pressure.

In accordance with this invention, the inlet sump 120 includes a pressure vessel 124 that is designed for the pressure of the liquid at the inlet to the pump. This pressure vessel 124 is mounted at its proximal, or upper end to the warm end of the pump 100, and is nominally an axisymmetric structure, with the axis of the pressure vessel being nominally co-extensive with the center line of the outer cylinder 108 and piston assembly 110. The pressure vessel 124 is fabricated of a material suitable for cryogenic temperatures and otherwise is compatible with the liquid to be pumped.

As can be seen in FIG. 2, the pressure vessel 124 of the sump is mounted to an adaptive plate 126 at the warm end of the pump 100, and this plate serves as a closure for the sump pressure cavity within the pressure vessel. The sump 120 is designed to minimize heat transfer from its warm upper end to the cold bottom end and must be suitable for maintaining the thermal gradient along its vertical length.

The exterior surface of the pressure vessel 124 is insulated by a vacuum jacket, schematically indicated at 128, or by an other suitable insulating means for preventing heat transfer (illustrated schematically by wavy lines 130) from the surrounding ambient into the sump 120.

As is illustrated in FIG. 2, cryogenic liquid to be handled by the pump 100 enters the sump 120 through a suitable inlet conduit indicated schematically at 132 via an opening in the wall of the pressure vessel 124. Thereafter, liquid is drawn into the pump 100 from the sump 120 through inlet valve 134, which is of a conventional design that is capable of functioning under cryogenic temperature conditions. It should be understood that liquid is drawn into the pump 100 by a reduced pressure in the distal swept volume that is created by the upward, or suction stroke of the piston assembly 110.

On the other hand, liquid discharged from the pump 100 by the downward movement of the reciprocating piston assembly 110 through a dispensing stroke exits through outlet valve 136 and is routed out of the sump 120 via a stationary, but separable, sealed connection 138. This sealed connection permits removal of the pump 100 from the sump 120 for maintenance, or for any other desired purpose.

Alternatively, the discharged liquid may be directed out of the sump 120 by routing it through the adaptive plate 126, as is schematically illustrated by the dash line 127, for applications where heat transfer to the discharged liquid is permissible. In this latter arrangement, the adaptive plate 126 must be suitably designed for receiving a local cold penetration, and such a design is obvious to persons skilled in the art, and is often found on cryogenic vacuum jacketed assemblies. Accordingly, the particular design employed for receiving local cold penetration is not considered to be a limitation on the present invention, and will not be discussed further herein.

The sump 120, in addition to serving as a storage vessel for the cryogenic liquid to be pumped by pump 100, also serves as an accumulator to minimize pump suction pressure fluctuations during each reciprocating cycle of the piston assembly 110. The volume of vapor 140 above the liquid in the sump 120 serves as a compressible element allowing a cyclic, minor rise and fall of the sump liquid level 142 during each piston assembly reciprocating cycle, with consequently minimized pressure changes or variations in the sump.

Maintenance of the sump liquid level 142 can be controlled by several methods, depending largely upon the application of the pump in a larger system. One method is by controlling the thermal gradient along the sump vessel, in the same manner as described above for controlling the liquid/gas interface level inside the closed cylinder 108. To provide a well-defined location for the liquid level 142, a thermally conductive element 144 is mounted through the adaptive plate 126 at the warm upper end of the sump vessel 124 to the lower cold location desired for the sump liquid level. The outer surface of the thermally conductive element 144 shall be thermally insulated from heat transfer to the volume of vapor 140 above the liquid in the sump 120, except for the distal end thereof. The lower, or distal end of the element 144 provides a boiling initiation point for a rising liquid level. The warm upper end of the thermally conductive element 144 may be maintained at a suitable warm temperature by a conductive design, a convection design to the ambient atmosphere, by electrical elements, or by any other means suitable for that purpose. The particular means employed for maintaining the upper end of the conductive element 144 warm is not considered a limitation on the broadest aspects of the present invention, the particular means employed being obvious to persons skilled in the art.

Figure 3:
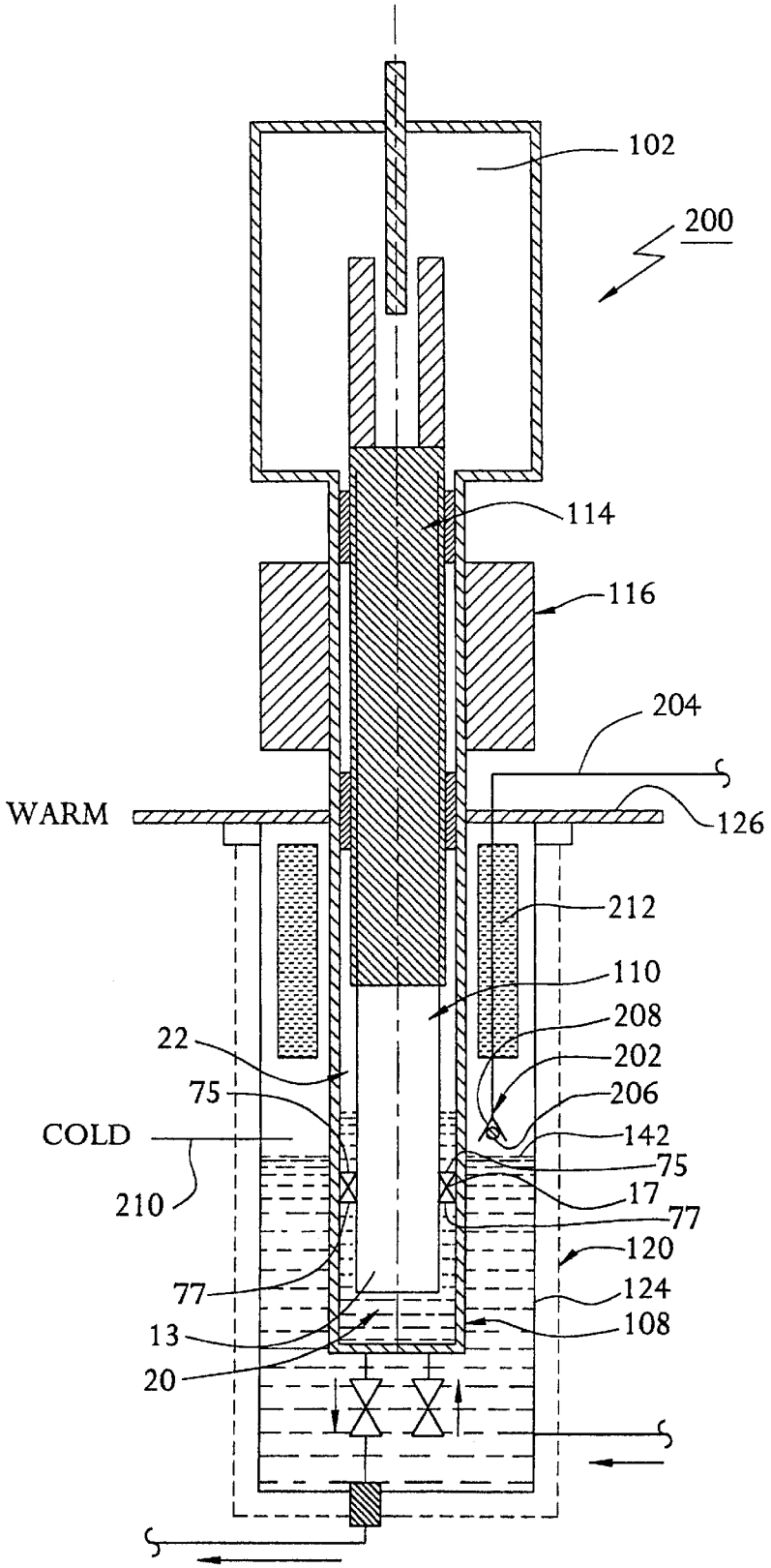
FIG. 3 is a schematic, sectional view of yet another embodiment of a hermetic reciprocating pump in accordance with this invention.

Referring to FIG. 3, an alternative embodiment of a hermetic reciprocating pump in accordance with this invention is illustrated at 200. The construction of this pump is substantially identical to the construction of the pump 100, and therefore elements in the pump 200 that are identical to elements in the pump 100 are given the same numerals as employed in FIG. 2, and function in the same manner as described above in connection with FIG. 2. These elements will not be discussed in detail in connection with the pump 200. It should be understood that the magnetic drive system employed in the pump 200 is identical to the drive systems employed in the pumps 10 and 100, and therefore will not be discussed further herein.

The pump 200 differs from the pump 100 in the construction and method for controlling the sump liquid level 142. In particular, the method and system for controlling the sump liquid level 142 in the pump 200 is desirable for applications that require periods of low, or zero pump flow, but where the pump and the sump must be maintained at a cold temperature for quick restart. In this embodiment, a float valve 202 is connected to a sump vapor vent line 204. The float valve 202 is located within the sump vessel 124 at the desired sump liquid level. When the liquid level condition is below the float valve 202, indicating a low liquid level condition, the float valve 202 opens by allowing valve plug 206 to open off of valve seat 208 by gravitational effect. This opening of the valve 202 allows vapor to vent from the sump 120 through the vapor vent line 204, based upon the vent line terminating at a sink of lesser pressure than the pressure within the sump. The venting of vapors through the vapor vent line 204 allows the liquid level in the sump 120 to rise, as a greater inlet flow of liquid to the sump occurs based on the reduction of sump pressure by vapor removal.

Conversely, a high liquid level within the sump 120 closes the float valve 202. By closing the vapor vent line from the sump, the vapor volume increases due to boiling of the sump liquid that is caused by normal heat transfer from the warm end of the sump vessel 124 down to the distal, or cold end thereof. This process reaches a nominally stable point with the liquid level 142 being in the general vicinity of the float valve 202. In this arrangement, a conductive element, such as the thermally conductive element 144 illustrated in FIG. 2, may be employed to augment the boiling process under high liquid level conditions. The use of the float valve 202 and the connected sump vapor vent line 204 prevents low or zero pump flow conditions from boiling the sump dry.

It should be noted that the inlet sump liquid level 142 establishes the lower, or distal point of the thermal gradient region 210 of the cylinder and piston assembly. Liquid in the inlet sump 120 also removes frictional heat from the wall of the cylinder 108, as is generated by movement between the liquid sealing member 17 and the piston 13. In a preferred embodiment of this invention, an anti-convection and insulating structure 212 is mounted in the vapor space of the sump 120 to minimize excessive heat transfer through the vapor from the upper warm end to the lower cold end of the sump vessel 124. This anti-convection and insulating structure 212 can be of any conventional design capable of providing its intended function, as set forth herein.

Figure 4:
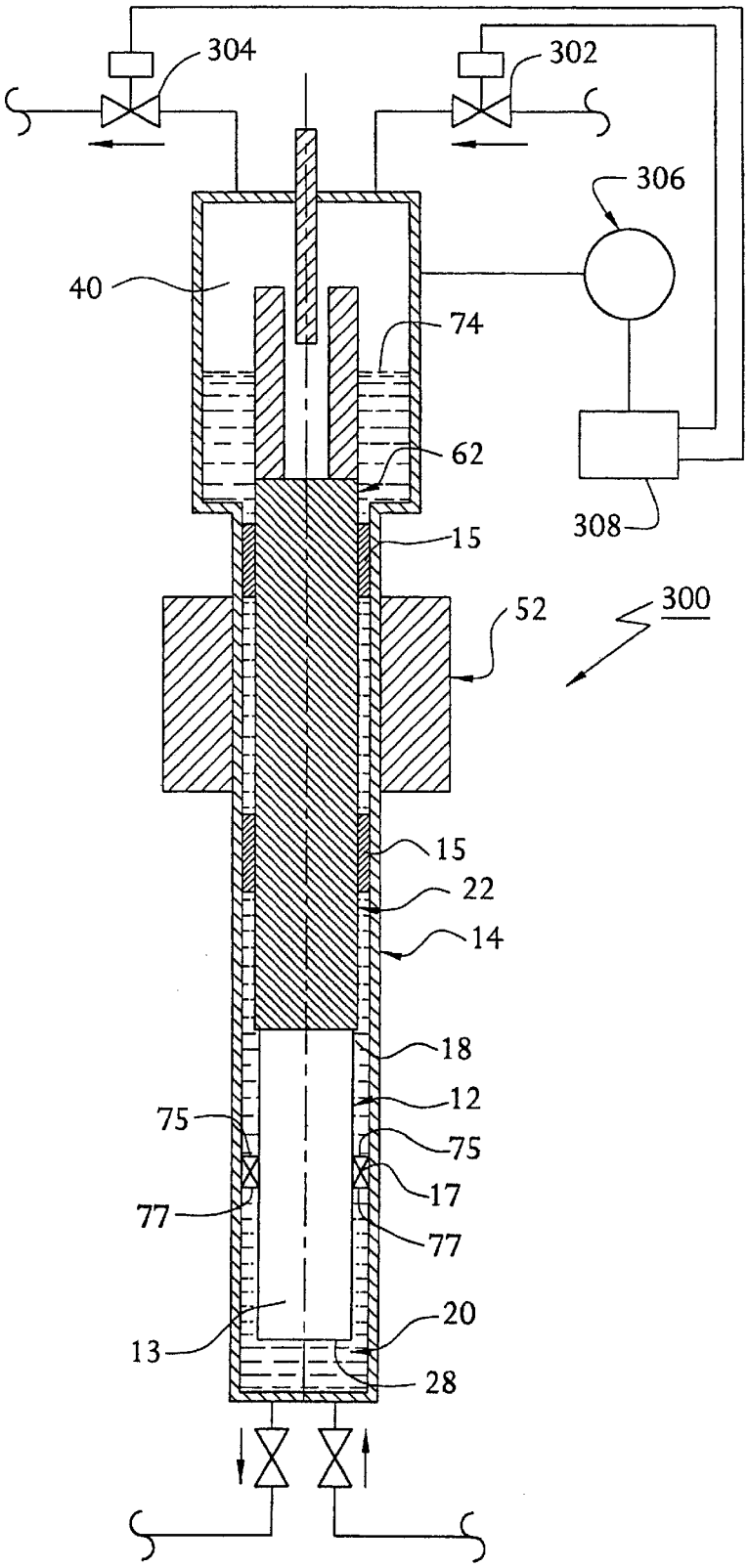
FIG. 4 is a schematic, sectional view of yet another embodiment of a hermetic reciprocating pump in accordance with this invention.

Referring to FIG. 4, a further embodiment of a hermetic reciprocating pump in accordance with this invention is illustrated at 300. The pump 300 is very similar to the pump 10 illustrated in FIG. 1, but is constructed in a manner to provide a gas volume above the piston assembly that can be filled with a non-condensible gas that is different from the vapor of the liquid being pumped. For purposes of brevity, elements in the pump 300 that are the same as corresponding elements in the pump 10 are identified by the same numerals employed in FIG. 1, and will not be discussed in detail herein. It should be noted that the magnetic drive system employed in the pump 300 is identical to the drive systems employed in the earlier described pumps 10, 100 and 200.

The pump 300 is specifically designed for pumping liquids that are more nearly at ambient temperature (non-cryogenic liquids) and where the inlet temperature vapor pressure of such liquids is a small fraction of the average of the inlet and outlet liquid pressures. In this type of pump the region of upper section 40 of the reservoir chamber 22 above the piston assembly 12 must be filled with a non-condensible gas. A desired inventory of the gas must be maintained by adding or removing gas through the upper volume inlet and outlet gas controlled valves 302 and 304, respectively. The operation of these valves 302 and 304 to maintain the proper location of the liquid/gas interface 74 along the length of the piston assembly 12 is effected, or controlled by suitable liquid-level measurement instruments and controls, which are well known to persons skilled in the art and do not form a limitation on the broadest aspects of the present invention. For example, there are several potentially suitable methods for sensing liquid level and controlling the operation of the valves to maintain the required level, the particular selection of which would be obvious to persons skilled in the art. In the illustrated embodiment, the pump 300 is provided with a pressure transducer 306 communicating with the upper interior region of the upper section 40 of the reservoir chamber 22. The pressure of the gaseous substance in the upper section 40 of the reservoir chamber 22 normally will fluctuate between a maximum and a minimum value during each cycle of reciprocating motion of the piston assembly 12. A valve controller 308 is controlled by the output of the pressure transducer to operate the control valves 302 and 304 in a manner designed to keep the gas pressure fluctuation peak differential between acceptable maximum and minimum predetermined values. An excessively low gas volume increases the cyclic pressure fluctuation differential. An excessively high gas volume decreases the cyclic pressure fluctuation differential. Selection of the non-condensible gas for the upper volume 40 must be compatible with the liquid being pumped and preferably should not be considered a contaminant in the pump discharge stream, since some amount of the gas will be dissolved into the pumped liquid.

Figure 4A:
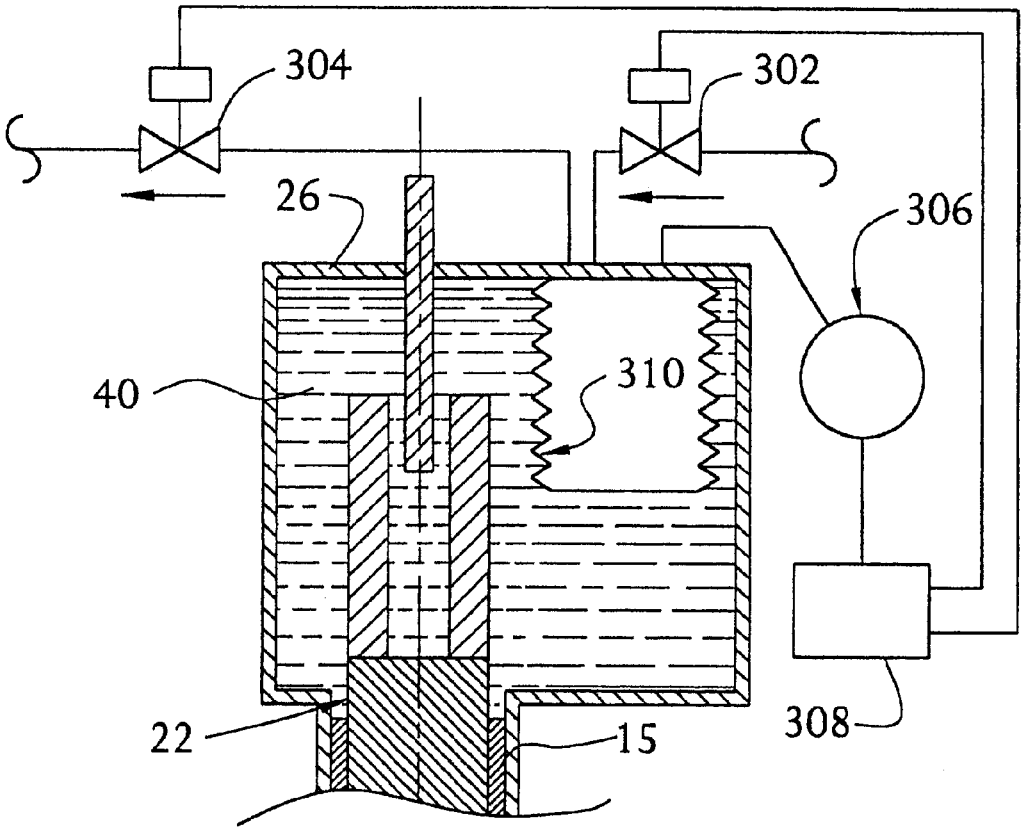
FIG. 4A is a fragmentary sectional view of a modified reservoir chamber arrangement in accordance with yet another embodiment of a hermetic reciprocating pump in accordance with this invention.

Referring to FIG. 4A, a modified construction to the pump 300 is illustrated, which permits the pump to be employed with a non-condensible gas that may not be compatible with the liquid being pumped, and may actually be a contaminant for that liquid. In this modified construction a flexible member 310, preferably in the form of a stainless steel bellows, is provided for retaining the non-condensible gas and separating that gas from the liquid in the upper section 40 of the reservoir chamber 22. The bellows 310 communicates with a gas inlet and outlet through inlet and outlet gas controlled valves 302 and 304, respectively. The operation of these valves 302 and 304 to maintain a desired gas pressure in the bellows can be the same as described above in connection with the embodiment of the pump shown in FIG. 4. Specifically, the pump can be provided with a pressure transducer 306 communicating with the interior region of the bellows 310 through an upper wall 26 of the reservoir chamber 22. The pressure of the gaseous substance in the bellows normally will fluctuate between a maximum and a minimum value during each cycle of reciprocating motion of the piston assembly 12. A valve controller 308 is controlled by the output of the pressure transducer to operate the control valves 302 and 304 in a manner designed to keep the gas pressure fluctuation peak differential between acceptable maximum and minimum predetermined values. An excessively low gas volume increases the cyclic pressure fluctuation differential. An excessively high gas volume decreases the cyclic pressure fluctuation differential.

Figure 5:
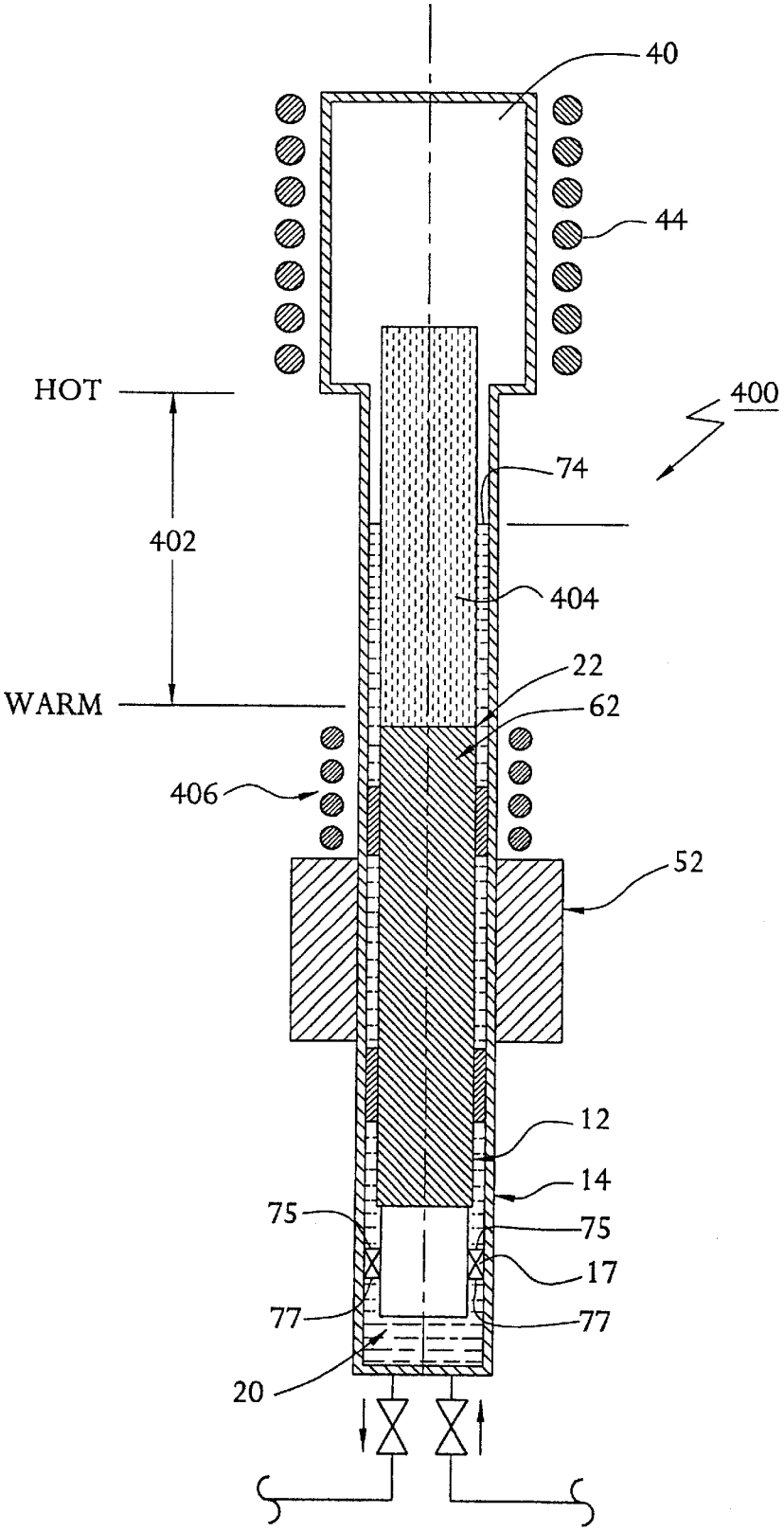
FIG. 5 is a schematic, sectional view of yet another embodiment of a hermetic reciprocating pump in accordance with this invention.

Referring to FIG. 5, yet another embodiment of a hermetic reciprocating pump in accordance with this invention is illustrated at 400. This pump 400, like the pump 300, includes a number of elements that are similar to the pump 10 illustrated at FIG. 1. However, the pump 400 has specific features that make it extremely well suited for use in pumping liquids that are nearly at ambient temperatures and where the vapor pressure of such liquids at the inlet temperature is a significant fraction of the liquid inlet pressure and wherein the vapor pressure rises significantly with an increase in temperature. In this environment the region of upper section 40 of the reservoir chamber 22 above the piston assembly 12 may be composed solely of vapor from the liquid if the upper section 40 above the piston assembly is maintained at a temperature above that of the liquid below, by employing various heat transfer means 44 to maintain the proper gas volume. The heat transfer means 44 can be any well known device as discussed previously in connection with the pump 10 illustrated in FIG. 1. That discussion will not be repeated herein, for purposes of brevity. Likewise, a heat transfer means 406 may be necessary to be provided at the warm end of the thermal gradient 402 to maintain said thermal gradient. This heat transfer means 406 may be cooling water coils, ambient convection heat transfer surfaces or any other means as is well known to those skilled in the art.

The pump 400 may be used for pumping liquid propane or as a boiler feed water pump. in the latter application, the upper structure 40 of the pump 400 can be heated with excess steam from the boiler, with combustion flu gas, or by independent means, as disclosed earlier. For these applications, the stator 52 and armature 62 most preferably are mounted near the distal, or lower temperature end of the pump, where the liquid to be pumped is located. It should be noted that the magnetic drive system employed in the pump 400 is identical to the drive systems employed in the earlier described pumps 10, 100, 200 and 300, and therefore will not be discussed further herein.

A thermal gradient region, illustrated schematically by the numeral 402 is designed to exist in the liquid to be pumped, as well as in the outer cylinder 14 and piston assembly 12 between the thermally separated hot and warm ends of the pump. The liquid/gas interface surface 74 is located in this thermal gradient region.

It is important to establish a desired thermal isolation of the two temperature zones in the pump 400, since excessive temperature is detrimental to components of the linear motor drive system, such as the permanent magnets and insulation on the electrical windings forming part of the stator. To achieve the desired thermal isolation between the two temperature zones, an insulating spacer 404 is provided as part of the piston assembly 12. This insulating spacer 404 also prevents excessive mixing of liquid above the armature 62. Such mixing can cause increased heat transfer between the two temperature regions.

Figure 6:
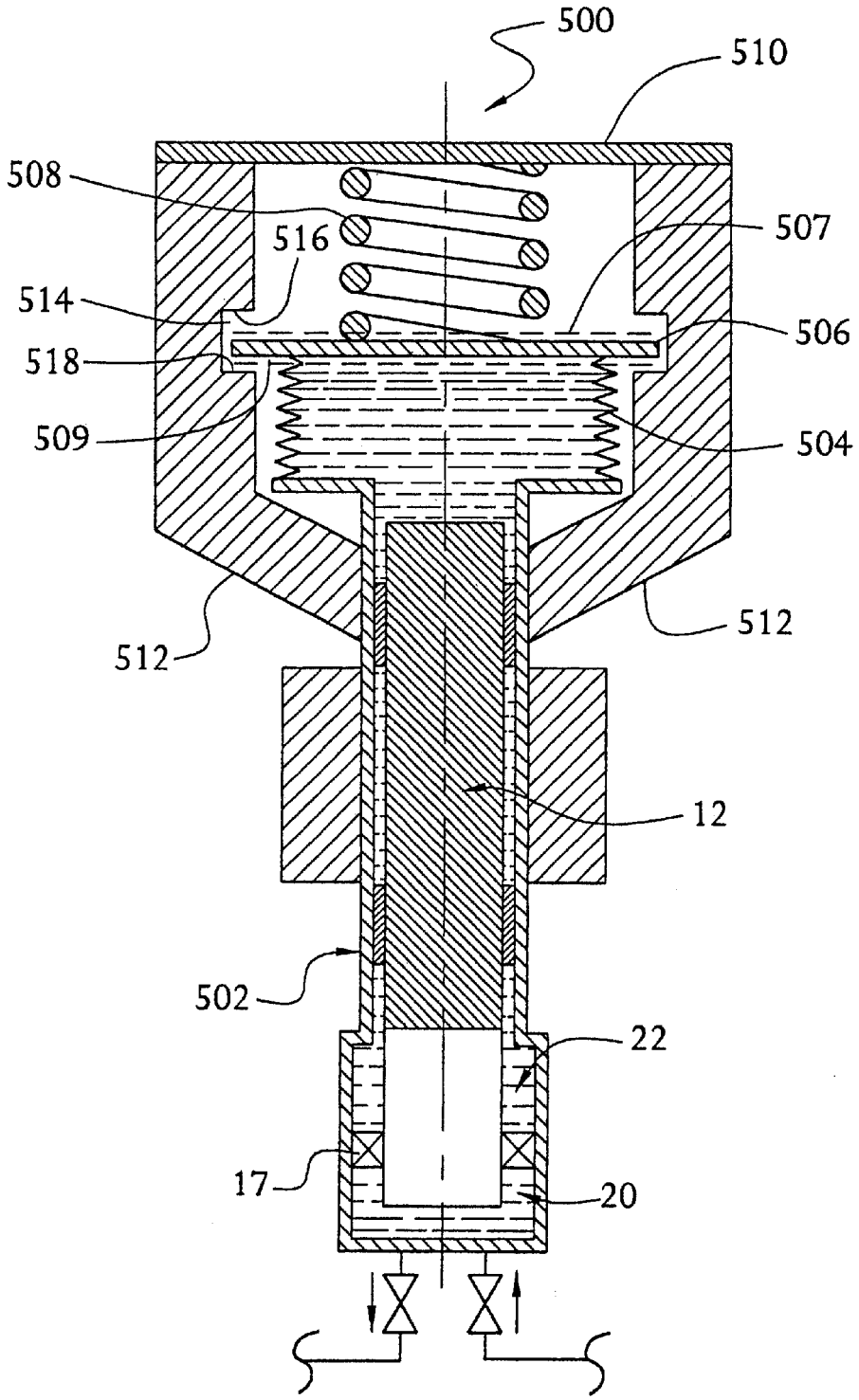
FIG. 6 is a schematic, sectional view of yet another embodiment of a hermetic reciprocating pump in accordance with this invention.

Referring to FIG. 6, a further embodiment of a hermetic pump in accordance with this invention is illustrated at 500.

This pump differs from earlier disclosed embodiments in that a gaseous substance is not relied upon to provide the energy storage and release functions. Moreover, the energy storage and release media in the pump 500 is external to piston cylinder 502, which houses the reciprocating piston assembly 12.

The features of the pump 500 that are the same or substantially the same as the features in the pump 10 illustrated in FIG. 1 will be referred to by the same numerals as employed in FIG. 1.

The reciprocating piston assembly 12 is substantially identical to the earlier described piston assemblies, but may be somewhat shorter in length. As in the above-described embodiments, a sealing member 17 is provided between the piston assembly 12 and the cylinder 502, to separate the interior compartment into a dispensing chamber 20 and a reservoir chamber 22.

As can be seen in FIG. 6, the reservoir chamber 22 of the cylinder 502 includes an upper bellows section 504 and is completely filled with liquid being pumped. Since the liquid filling the reservoir chamber 22 is essentially non-compressible, and since very little leakage of the liquid passed the sealing member 17 will occur, the volume within the reservoir chamber is relatively fixed.

As can be seen in FIG. 6, the upper end of the bellows section 504 includes a force transmitting end plate 506 against which one end of a compression spring 508 is biased. The opposed end of the compression spring is biased against a proximal mounting plate 510 of the pump that is secured to one end of circumferentially spaced-apart support members 512. The opposed ends of the support members 512 are secured by any suitable means (e.g., welding) to the outer surface of the cylinder 502. The number of spaced-apart support members can be varied to provide support for the mounting plate 510 at multiple locations, e.g., 3 or 4. It should be understood that in the pump 500 the compression spring 508 is the energy storage and release media.

Each of the support members 512 includes a notch 514 intermediate its ends to provide downwardly and upwardly facing stop surfaces 516 and 518, respectively. These stop surfaces limit the amount of permitted extension and permitted compression of the bellows 504 to thereby preserve the elastic characteristic of said bellows. These stop surfaces 516 and 518 are not intended to be controlled by the force transmitter end plate 506 during normal operation, but rather are limits to motion during start-up, shut-down or other transient occassions.

As the piston assembly 12 moves through a suction stroke toward the proximal mounting plate 510, the swept volume of the piston assembly in the reservoir chamber 22 will displace the non-compressible liquid therein; resulting in an extension of the bellows 504 and the force transmitting end plate 506. This extended (proximal) position of the force transmitting end plate 506 is shown in dotted line representation at 507. This, in turn, compresses the spring 508 to store potential energy therein. On the reverse, or dispensing stroke of the piston assembly 12, the stored energy in the spring is imparted to the end plate 506, the liquid therein, and then to the upper end of the piston assembly 12. The compressed (distal) condition of the force transmitting end plate 506 is shown in dotted line representation at 509.

Limits to the operational liquid inlet pressure to the pump and outlet pressure from the pump are dictated by the need to protect the bellows 504 from over extension and/or compression, to thereby preserve the elastic characteristics of the bellows, and, more specifically, to prevent operational impacting of the end plate 506 against the stop surfaces 516 and 518. A mechanism (not shown) can be provided to vary, or change the nominal or average compression of the energy storage spring 508 in order to modify the permissible pump inlet and outlet pressures. For example, a screw adjustment can be provided for relocating the proximal end of the spring 508 relative to the mounting plate 510. However, such a relocating mechanism has disadvantages that are not present in the use of a gaseous substance as the energy storage and release media. In the use of a mechanical spring, the amount of spring force change per change in spring deflection (i.e., the spring constant) is fixed, regardless of the amount of deflection of the spring from its free length. It should be noted that the amount of cyclic (maximum to minimum) spring deflection required is always constant if the stroke of the piston assembly is constant. Assuming a constant piston stroke, the maximum to minimum change in spring force is constant through each cycle, even as the average spring operation length and average force may be adjusted by moving the location of the proximal end of the spring in either the proximal or distal directions. This results in a maximum to minimum force ratio that is changing with the adjustment in average spring compression and force. At lower average pump pressures in the dispensing chamber 20, where the average spring 508 compression and force is low, the ratio of maximum to minimum spring force increases. As the minimum spring force approaches zero, the force ratio approaches infinity. Because liquid pressure in the reservoir chamber 22 is directly proportional to the spring force, this pressure also fluctuates to a greater and greater degree at each point in the cyclic motion of the piston assembly, as the average pressure of the liquid inlet and outlet of the pump decreases. For example, with a fixed inlet pressure this occurs if the discharge pressure drops. A significantly fluctuating pressure in the reservoir chamber 22 is detrimental to achieving a maximum and constant energy output from the linear motor.

On the other hand, employing a gaseous substance as the energy storage and release media does not have such a limitation due to the flexibility of being able to adjust its gas inventory. Filling or venting inventory of the gaseous substance changes not only the force it provides at a nominal volume, but also changes the "spring constant." The result is that for a given cyclic change in volume, the change in force on the piston assembly and thus the change in pressure on the proximal side of the piston has a fixed ratio of maximum to minimum values. This assures that the energy flow from the linear motor can be maintained at a more nearly constant level for both the suction and dispensing strokes in each cycle of the piston assembly motion. This assures maximum efficiency of the overall pump system.

It should be noted, however, that the pump 500 has advantages; particularly for certain niche applications. Given that the pump 500 is limited to operating within a narrower range of inlet and outlet pressures, as discussed above, the resulting configuration is relatively compact and there are no complicated control means for preserving thermal gradients or controlling the volume of gas in any energy storage and release media. A desirable application for the pump 500 is one in which the inlet and outlet pressures are very stable. A further advantage is that this pump may be mounted in any position and subjected to any degree of accelerative motion, since there is no natural liquid-to-gas interface surface that would, or could, be disrupted to cause the pump to loose gas inventory from the proximal side of the cylinder.

It should be understood that a number of variations can be made in the pump designs in accordance with this invention for pumping liquids with temperatures below and above ambient and of varying relative vapor pressures. In accordance with certain preferred embodiments of this invention, it is important to establish and maintain a proper volume of gas above the piston assembly during operation, and to establish acceptable thermal gradients between the reservoir and dispensing chambers in the piston cylinder, where required (e.g., when pumping cryogenic liquids).

From the above discussion, it should be apparent that the reciprocating pumps of the present invention are well suited for use in industrial processes and employ a unique cooperation of a linear motor drive system for driving a piston assembly via lines of magnetic force and the closure of the swept volume in the reservoir chamber on the back side of the piston assembly either to contain an energy storage and release media, e.g., a gaseous volume, or cooperate with an energy storage and release media, e.g., a spring, while maintaining a hermetically sealed device. The linear motor drive system employed in the hermetically sealed pumps of this invention replaces the use of conventional mechanical drive system, e.g., rotary motors with rotary to linear motion conversion devices, in pumps which are not hermetically sealed.

The pumps of the present invention have many advantages that are applicable to the pumping of both cryogenic and non-cryogenic liquids. In all forms of the invention, the pumps may employ a commercially available linear motor design that is designed to operate at or near room temperature. For applications wherein the liquids to be pumped do not permit coupling of the motor in close proximity to the pumping section, such as is the case for pumping cryogenic fluids, the present invention employs a single acting piston arrangement and establishes adequate physical separation of the pump from the linear motor.

The present invention has numerous advantages, particularly over existing cryogenic reciprocating pumping devices. Moreover, many of these advantages are applicable to non-cryogenic pumping applications, as have been detailed previously herein.

As noted earlier, the geometry of establishing the cylindrical air gap in the linear motor of the present invention between the stator and the armature permits a non-magnetic liner to be affixed to the bore of the stator in the air gap. This isolates the stator assembly from the armature, allowing stator materials and construction to be standard, as provided from the manufacture of the linear motor. In other words, this isolation avoids requirements for material compatibility with the pump fluid, such as may be necessary for liquid oxygen or other aggressive liquids. Furthermore, because the application of force for work input to the piston assembly is by lines of magnetic force acting through the stator liner, the liner may be made integral with the pressurized liquid boundary of the pump section, thus creating a totally hermetically sealed pump design.

The present invention, unlike the prior art, very effectively minimizes leakage past the piston seal by raising the pressure in the reservoir chamber on the back, or proximal side of the piston. This is achieved with virtually no detriment to piston rod packing leakage or reduced life of the piston rod, since dynamic seals preventing leakage to the ambient surroundings of the pump employed in conventional prior art pumps that are normally subjected to excessive wear are not employed in the most preferred pump constructions of the present invention. Because piston seal leakage is bidirectional in the pumps of this invention and not lost from the liquid inventory within the pump, the design of the seal can allow somewhat greater leakage rates with a corresponding benefit in reduced frictional heat input to the pumped liquid by reduction of seal contact pressure. While piston seal leakage may represent a nominal loss of pump volumetric efficiency, the greater benefit is reduction of heat load on the pumped stream, thus reducing undesired vaporization.

The reciprocating pumps of the present invention, which all employ a linear magnetic motor, offer significant advantages over prior art reciprocating pumps that employ rotary to linear mechanical conversion devices to reciprocate a piston rod assembly, generally through a fixed piston stroke length and generally fixed sinusoidal motion. The linear motors employed in the pumps of the present invention offer adjustable stroke length operation and programmable motion definition versus fixed sinusoidal motion. These flexibilities in operation of the pumps of the present invention are adjustable before operation of the pump, or while the pump actually is in service. Minimization of peak piston velocity on the inlet portion of the piston motion and non-equal suction and discharge time periods are considered to be beneficial in controlling cylinder pressure reduction effects on the overall pump required NPSH. Such velocity and time controls are not achievable with conventional mechanical conversion devices, e.g., slider-crank linkage system, commonly employed in prior art pumps. Moreover, the ability to adjust the stroke, speed and motion of the piston assembly in the linear motor driven pumps of this invention permits the use of such pumps for duties that are not possible with current reciprocating cryogenic pumps. This theoretically includes operation of the pumps of the present invention at any flow rate from 0 to 100% of design, a mode of operation not achievable in prior art constructions. In particular, prior art reciprocating pumps use flywheels for speed stabilization and cannot achieve this wide range of output flow rates. Specifically, flywheels store energy based on kinetics, which is speed dependent. The present invention stores energy by gas pressure or other elastic compressive or expansive media, which is independent of speed.

Prior art reciprocating pump designs have tended to reduce total reciprocating weight in order to limit vibration effects to the installation and pump bearings. In view of the fact that the pumps of the present invention are permitted to operate with longer stroke lengths and slower cyclic rates, the limitation on reciprocating weight is eased. This permits an increase in length between the warm and cold end of cryogenic pumps in accordance with the present invention, which thereby decreases the thermal heat leak into the cold end of the pump. While applicant considers this to be a significant benefit for thermodynamic pump efficiency and reduction of NPSH requirement, it also permits a "constant cold-on standby" situation. In this regard, prior art constructions have a pump cold end relatively closely coupled to the warm end. Thus, the cold end warms quickly after the pump is shut down; a problem that is not encountered with the pumps of the present invention. Thus, prior art pumps require a period of cool-down prior to restart if the period of pump outage is more than several hours. This represents a nuisance in operation and a loss of product to vaporization occurring during the cool-down process. The present invention eliminates or minimizes this cool-down requirement so long as liquid inventory remains available to the pump suction. An acceptably small residual liquid vaporization in cold standby will be returned to the ullage volume of the cryogenic liquid storage source tank to maintain its desired benefit.

A still further benefit of the present invention is that it offers a decrease in mechanical complexity and a corresponding reduction of maintenance requirements. As noted earlier, in contrast to prior art reciprocating pumps, the pumps of the present invention have fewer moving parts, including no crankshaft, connecting rod, piston rod, crosshead, wrist-pin, flywheel, belts and/or motor pulleys. Likewise, the stationary part count is reduced by eliminating numerous parts, e.g., belt guard, motor mount, slider, crank housing, main bearings, shaft seals, piston rod distance piece, and piston rod packing and rod wiper assembly. In the present invention these later components are replaced with an electronic control and power package requiring substantially less maintenance than its mechanical counterparts.

Without further elaboration, the foregoing will so fully illustrate my invention that others may, by applying current or future knowledge, readily adapt the same for use under various conditions of service.

What is claimed:

1. A method for pumping a liquid including the steps of:

(a) providing a pump including a piston assembly mounted for reciprocating movement in a closed interior compartment of a piston cylinder having opposed closed ends, the piston assembly including a dispensing end and an opposed end;

(b) generating a linearly moving magnetic field for reciprocating the piston assembly within the cylinder through a dispensing stroke and a suction stroke, respectively;

(c) providing a sealing member between the piston assembly and piston cylinder to maintain a dynamic fluid seal between the piston assembly and piston cylinder during the entire linear dispensing and return strokes of said piston assembly, said sealing member dividing said interior compartment into a dispensing chamber housing the liquid to be dispensed and a reservoir chamber;

(d) introducing liquid to be pumped into the dispensing chamber;

(e) maintaining the liquid in the cylinder at a level such that a lower surface of the sealing member and the dispensing end of the piston assembly are maintained within the liquid throughout the length of the dispensing and suction strokes of the piston assembly; and (f) providing an energy storage and release media in a location for storing energy when the piston assembly is moved through the suction stroke and for imparting the stored energy to the piston assembly as the piston assembly is moved through the dispensing stroke.

2. The method of claim 1, including the step of providing the energy storage and release media in the reservoir chamber of the interior compartment.

3. The method of claim 1, including the step of generating the linearly moving magnetic field through an electronic power supply controlled by a programmable microprocessor.

4. The method of claim 1, including the steps of determining the position of the piston assembly within the cylinder and controlling the linearly moving magnetic field in response to that determination.

5. The method of claim 1, including the step of generating the linearly moving magnetic field with a linear magnetic drive employing a stator and armature, the stator being located adjacent and outside of the piston cylinder of the pump and the armature being located on the piston assembly inside the piston cylinder to thereby create an air gap between the inner surface of the stator and the outer surface of the armature in which the outer wall of the piston cylinder is disposed.

6. The method of claim 2, wherein said energy storage and release media includes a gaseous substance.

7. The method of claim 6, including the step of establishing and maintaining a defined, liquid/vapor interface in the reservoir chamber between the liquid and the gaseous substance during operation of the pump.

8. The method of claim 6, including the step of filling the reservoir chamber with said gaseous substance to a level such that the opposed end of the piston assembly is in said gaseous volume during the entire dispensing and suction strokes of said piston assembly.

9. The method of claim 6, wherein the gaseous substance is non-condensible and is not a vapor of the liquid being pumped, including the steps of supplying and discharging controlled amounts of said non-condensible gaseous substance to said pump.

10. The method of claim 6, wherein the gaseous substance is a vapor of the liquid being pumped.

11. The method of claim 6, wherein the gaseous substance is partially composed of vapor from the liquid being pumped and is partially composed of a non-condensible gas that is not a vapor of the liquid being pumped, including the steps of supplying and discharging controlled amounts of said non-condensible gas to said pump.

12. The method of claim 1, including the step of modulating the linear moving magnetic field during the pumping operation to vary the motion of the piston assembly.

13. The method of claim 12, wherein varying the motion of the piston assembly includes varying one or more of the length of stroke of the piston assembly in each linear direction, the time period of the stroke of the piston assembly in each linear direction, the cyclic rate of reciprocation of the piston assembly including the position, velocity and acceleration of the piston assembly throughout the entire path of movement of the assembly in the opposed linear directions at every point in time of that cyclic motion.

14. The method of claim 13, including the step of providing different time durations for the dispensing stroke and the suction stroke, respectively.

15. The method of claim 13, including the step of providing a time delay of motion between successive reciprocating cycles of the piston assembly, each reciprocating cycle including one dispensing stroke and one suction stroke.

16. The method of claim 13, including the step of providing a time delay of motion at one or more of various locations within any cycle of the piston assembly, each cycle including one dispensing stroke and one suction stroke.

17. The method of claim 1, including the step of providing liquid to be pumped into the piston cylinder from a liquid sump.

18. The method of claim 17, including the step of maintaining the liquid level in the sump at a desired elevation.

19. The method of claim 17, including the step of partially filling the sump with the liquid to be pumped and including a compressible media in a ullage space within the sump.

20. The method of claim 2, including the step of insulating the outer cylinder of the pump in a region of the dispensing chamber to maintain the liquid to be pumped at a desired cold temperature and heating a region of the reservoir chamber to maintain said region of said reservoir chamber at a desired warm temperature and maintaining the pressure of the gas in the reservoir chamber below the critical pressure of the gas.

21. The method of claim 20, wherein the liquid to be pumped is a liquefied gas.

22. The method of claim 20, wherein the liquid to be pumped is a cryogenically liquefied gas.

23. The method of claim 2, including the step of insulating the outer cylinder of the pump in a region of the dispensing chamber to maintain the liquid to be pumped at a desired cold temperature and heating a region of the reservoir chamber to maintain said region of said reservoir chamber at a desired warm temperature and maintaining the pressure of the gas in the reservoir chamber at or above the critical pressure of the gas.

24. The method of claim 23, wherein the liquid to be pumped is a liquefied gas.

25. The method of claim 23, wherein the liquid to be pumped is a cryogenically liquefied gas.

26. The method of claim 1, including the step of providing a bellows section in said reservoir chamber and communicating said energy storage and release media with said bellows section such that movement of the piston assembly through the suction stroke moves the bellows section to store energy in the energy storage and release media.

27. The method of claim 26, including the step of locating the bellows section inside the reservoir chamber and filling said bellows member with a gaseous substance, said gaseous substance being said energy storage and release media.

28. The method of claim 26, including the step of providing the bellows section as an end section of the reservoir chamber and engaging an outer wall of the bellows section with said energy storage and release media.

29. The method of claim 28, including the step of providing a spring member as the energy storage and release media.

30. The method of claim 28, including the step of filling the bellows section with a liquid.

31. A method for pumping a liquid including the steps of:

(a) providing a pump including a piston assembly mounted for reciprocating movement in a closed interior compartment of a piston cylinder having opposed closed ends, the piston assembly including a dispensing end and an opposed end;

(b) providing a linear magnetic drive including an armature and a stator, said stator being adjacent said armature and said armature being on said piston assembly for cooperating with the stator, (c) providing a modulating electric current to the stator for generating a linearly moving magnetic field that imposes a magnetic force on the piston assembly in opposed linear directions through said armature for reciprocating the piston assembly within the cylinder through a dispensing stroke and a suction stroke, respectively;

(d) providing a sealing member between the piston assembly and piston cylinder to maintain a seal between the piston assembly and piston cylinder during the entire linear dispensing and return strokes of said piston assembly, said sealing member dividing said interior compartment into a dispensing chamber housing the liquid to be dispensed and a reservoir chamber;

(e) introducing liquid to be pumped into the dispensing chamber;

(f) maintaining the liquid in the cylinder at a level such that a lower surface of the sealing member and the dispensing end of the piston assembly are maintained within the liquid throughout the length of the dispensing and suction strokes of the piston assembly; and (g) providing an energy storage and release media in a location for storing energy when the piston assembly is moved by the magnetic force through the suction stroke and for releasing the stored energy to the piston assembly as the piston assembly is moved through the dispensing stroke by the combined force provided by the release of the stored energy and by the magnetic force imposed on the piston assembly in the direction of the dispensing stroke by the linear magnetic drive.

32. The method of claim 31, including the step of providing the energy storage and release media in the reservoir chamber of the interior compartment.

33. The method of claim 31, including the step of generating the linearly moving magnetic field in the stator through an electronic power supply controlled by a programmable microprocessor.

34. The method of claim 31, including the steps of determining the position ofthe piston assembly within the cylinder and controlling the linearly moving magnetic field in response to that determination.

35. The method of claim 31, including the steps of generating the linearly moving magnetic field with a linear magnetic drive employing a stator and armature, locating the stator adjacent and outside ofthe piston cylinder ofthe pump to thereby create an air gap between the inner surface of the stator and the outer surface of the armature in which the outer wall of the piston cylinder is disposed.

36. The method of claim 32, wherein said energy storage and release media includes a gaseous substance.

37. The method of claim 36, including the step of establishing and maintaining a defined, liquid/vapor interface in the reservoir chamber between the liquid and the gaseous substance during operation of the pump.

38. The method of claim 36, wherein the gaseous substance is a vapor of the liquid being pumped.

39. The method of claim 36, wherein the gaseous substance is partially composed of vapor from the liquid being pumped and is partially composed of a non-condensible gas that is not a vapor of the liquid being pumped, including the steps of supplying and discharging controlled amounts of said non-condensible gas to said pump.

40. The method of claim 31, including the step of modulating the linear moving magnetic field during the pumping operation to vary one or more of the length of stroke of the piston assembly in each linear direction, the time period of the stroke of the piston assembly in each linear direction, the cyclic rate of reciprocation of the piston assembly including the position velocity and acceleration of the piston assembly throughout the entire path of movement of the assembly in the opposed linear directions at every point in time of that cyclic motion.

41. The method of claim 40, including the step of providing different time durations for the dispensing stroke and the suction stroke, respectively.

42. The method of claim 40, including the step of providing a time delay of motion between successive reciprocating cycles of the piston assembly, each reciprocating cycle including one dispensing stroke and one suction stroke.

43. The method of claim 40, including the step of providing a time delay of motion at one or more of various locations within any cycle of the piston assembly, each cycle including one dispensing stroke and one suction stroke.

44. The method of claim 31, including the step of providing liquid to be pumped into the piston cylinder from a liquid sump.

45. The method of claim 44, including the step of partially filling the sump with the liquid to be pumped and including a compressible media in a ullage space within the sump.

46. The method of claim 32, including the step of insulating the outer cylinder of the pump in a region of the dispensing chamber to maintain the liquid to be pumped at a desired cold temperature and heating a region of the reservoir chamber to maintain said region of said reservoir chamber at a desired warm temperature and maintaining the pressure of the gas in the reservoir chamber below the critical pressure of the gas.

47. The method of claim 46, wherein the liquid to be pumped is a liquefied gas.

48. The method of claim 46, wherein the liquid to be pumped is a cryogenically liquefied gas.

49. The method of claim 32, including the step of insulating the outer cylinder of the pump in a region of the dispensing chamber to maintain the liquid to be pumped at a desired cold temperature and heating a region of the reservoir chamber to maintain said region of said reservoir chamber at a desired warm temperature and maintaining the pressure of the gas in the reservoir chamber at or above the critical pressure of the gas.

50. The method of claim 49, wherein the liquid to be pumped is a liquefied gas.

51. The method of claim 49, wherein the liquid to be pumped is a cryogenically liquefied gas.

52. The method of claim 32, including the step of providing a bellows section in said reservoir chamber and communicating said energy storage and release media with said bellows section such that movement of the piston assembly through the suction stroke moves the bellows section to store energy in the energy storage and release media.

53. A method for pumping liquid including the steps of:

a. providing a pump including a piston assembly mounted for reciprocating movement in a closed interior compartment of a piston cylinder having opposed closed ends, the piston assembly including a dispensing end and an opposed end;

b. generating a linearly moving magnetic field for reciprocating the piston assembly within the cylinder through a dispensing stroke and a suction stroke respectively;

c. providing a sealing member between the piston assembly and piston cylinder to maintain a dynamic fluid seal between the piston assembly and piston cylinder during the entire linear dispensing and return strokes of said piston assembly, said sealing member dividing said interior compartment into a dispensing chamber housing the liquid to be dispensed and a reservoir chamber;

d. introducing liquid to be pumped into the dispensing chamber;

e. maintaining the liquid in the cylinder at a level such that a lower surface of the sealing member and the dispensing end of the piston assembly are maintained within the liquid throughout the length of the dispensing and suction strokes of the piston assembly;

f. providing an energy storage and release media including a gaseous substance in a location for storing energy when the piston assembly is moved through the suction stroke and for imparting the stored energy to the piston assembly as the piston assembly is moved through the dispensing stroke; and g. controlling the volume and pressure of the gaseous substance in said location for storing a desired amount of energy as a result of the movement of the piston assembly through the suction stroke and for releasing said desired amount of stored energy to the piston assembly as the piston assembly is moved through the dispensing stroke.

54. The method of claim 53, including the step of providing the energy storage and release media in the reservoir chamber of the interior compartment.

55. The method of claim 53, including the step of generating the linearly moving magnetic field through an electronic power supply controlled by a programmable microprocessor.

56. The method of claim 53, including the step of generating the linearly moving magnetic field with a linear magnetic drive employing a stator and armature, the stator being located adjacent and outside of the piston cylinder of the pump and the armature being located on the piston assembly inside the piston cylinder to thereby create an air gap between the inner surface of the stator and the outer surface of the armature in which the outer wall of the piston cylinder is disposed.

57. The method of claim 54, including the step of filling the reservoir chamber with said gaseous substance to a level such that the opposed end of the piston assembly is in said gaseous volume during the entire dispensing and suction strokes of said piston assembly.

58. The method of claim 54, wherein the gaseous substance includes a non-condensible substance that is not a vapor of the liquid being pumped and wherein the step of controlling the volume and pressure of the gaseous substance includes the steps of supplying and discharging controlled amounts of said non-condensible gaseous substance to said reservoir chamber for storing energy in said pump.

59. The method of claim 57, including the step of providing liquid to be pumped into the piston cylinder from a liquid sump.

60. The method of claim 59, including the step of maintaining the liquid level in the sump at a desired elevation.

61. The method of claim 59, including the step of partially filling the sump with the liquid to be pumped and including a compressible media in a ullage space within the sump.

62. The method of claim 54, including the step of providing a bellows section in said reservoir chamber and communicating said gaseous substance with said bellows section such that movement of the piston assembly through the suction stroke moves the bellows section to store energy in said gaseous substance.

63. The method of claim 62, including the step of locating the bellows section inside the reservoir chamber.

* * * * *